US008345027B2

(12) United States Patent
Asano

(10) Patent No.: US 8,345,027 B2
(45) Date of Patent: Jan. 1, 2013

(54) IMAGE DISPLAY DEVICE AND DRIVING METHOD OF IMAGE DISPLAY DEVICE

(75) Inventor: Mitsuru Asano, Kanagawa (JP)

(73) Assignee: Sony Corporation, Tokyo (JP)

( * ) Notice: Subject to any disclaimer, the term of this patent is extended or adjusted under 35 U.S.C. 154(b) by 783 days.

(21) Appl. No.: 12/379,901

(22) Filed: Mar. 4, 2009

(65) Prior Publication Data

US 2009/0256826 A1 Oct. 15, 2009

(30) Foreign Application Priority Data

Apr. 9, 2008 (JP) ..... 2008-101452

(51) Int. Cl.
*G09G 3/30* (2006.01)

(52) U.S. Cl. ..... 345/204; 345/205; 345/78

(58) Field of Classification Search ..... None
See application file for complete search history.

(56) References Cited

U.S. PATENT DOCUMENTS

2006/0221015 A1* 10/2006 Shirasaki et al. ..... 345/77

FOREIGN PATENT DOCUMENTS

| | | | |
|---|---|---|---|
| JP | 2007-133284 | A | 5/2007 |
| JP | 2007-310311 | A | 11/2007 |
| JP | 2008-026507 | A | 2/2008 |
| JP | 2008-039946 | A | 2/2008 |
| WO | WO-01/06484 | A1 | 1/2001 |

OTHER PUBLICATIONS

Japanese Office Action issued Jan. 26, 2010 for corresponding Japanese Application No. 2008-101452.

Japanese Office Action issued May 25, 2010 for corresponding Japanese Application No. 2008-101452.

* cited by examiner

*Primary Examiner* — Joseph Haley

(74) *Attorney, Agent, or Firm* — Rader Fishman & Grauer, PLLC

(57) ABSTRACT

Disclosed herein is an image display device for displaying input image data on a display section formed by arranging pixel circuits in a form of a matrix by driving the pixel circuits by a signal line driving circuit and a scanning line driving circuit via a signal line and a scanning line of the display section.

7 Claims, 26 Drawing Sheets

PRIOR ART

PRIOR ART

PRIOR ART

IMAGE DISPLAY DEVICE AND DRIVING METHOD OF IMAGE DISPLAY DEVICE

BACKGROUND OF THE INVENTION

1. Field of the Invention

The present invention relates to an image display device and a driving method of the image display device, and is applicable, for example, to an active matrix type image display device formed by an organic EL (Electro Luminescence) element. The present invention makes it possible to set the gate voltage of a driving transistor with high precision even when a plurality of signal lines are driven on a time division basis in an image display device driving a self-luminous element by the driving transistor, by setting at least the potential of a signal line to a precharge voltage in advance.

2. Description of the Related Art

Heretofore, an active matrix type image display device using organic EL elements has a display section formed by arranging pixel circuits including the organic EL elements and driving circuits driving the organic EL elements in the form of a matrix. This type of image display device drives each pixel circuit by a signal line driving circuit and a scanning line driving circuit disposed on the periphery of the display section to display a desired image.

In relation to the image display device using the organic EL elements, Japanese Patent Laid-Open No. 2007-310311 discloses a method of forming one pixel circuit using two transistors. Thus, according to the method disclosed in Japanese Patent Laid-Open No. 2007-310311, the configuration of the image display device can be simplified.

Japanese Patent Laid-Open No. 2007-310311 also discloses a constitution for correcting variation in threshold voltage and variation in mobility of a driving transistor for driving an organic EL element. Thus, according to the constitution disclosed in Japanese Patent Laid-Open No. 2007-310311, degradation in image quality due to variation in threshold voltage and variation in mobility of the driving transistor can be prevented.

In addition, Japanese Patent Laid-Open No. 2007-133284 proposes a constitution in which a process of correcting variation in the threshold voltage is divided and performed a plurality of times.

The image display device using the organic EL elements current-drives the organic EL elements using a driving transistor formed by a TFT (Thin Film Transistor). The TFT has a disadvantage of large variations in characteristics. The image quality of the image display device using the organic EL elements is degraded significantly by variation in threshold voltage, which variation is one of the variations in characteristics of the driving transistor. Incidentally, this degradation in image quality is perceived as stripes, luminance nonuniformity and the like.

More specifically, a driving current Ids made to flow through the organic EL element by the driving transistor is expressed by the following equation. Incidentally, Vgs in the equation denotes the gate-to-source voltage of the driving transistor. Vth denotes the threshold voltage of the driving transistor. μ denotes the mobility of the driving transistor. W denotes the channel width of the driving transistor. L denotes the channel length of the driving transistor. Cox denotes the capacitance of a gate insulating film per unit area of the driving transistor.

$$Ids = \frac{\beta}{2} \times (Vgs - Vth)^2 \tag{1}$$

$$\beta = \mu \times \frac{W}{L} \times Cox$$

Thus, the current Ids flowing through the organic EL element changes according to variation in the threshold voltage Vth of the driving transistor. As a result, the image display device using the organic EL element has light emission luminance varied in each pixel. When Equation (1) is modified, the following equation can be obtained.

$$Vgs = \left(Ids \times \frac{2}{\beta}\right)^{1/2} + Vth \tag{2}$$

Thus, when the organic EL element is driven by a driving current Iref, a gate-to-source voltage Vref can be expressed by the following equation.

$$Vref = \left(Iref \times \frac{2}{\beta}\right)^{1/2} + Vth \tag{3}$$

Thus, when a pixel circuit is formed so as to set the gate-to-source voltage Vgs of the driving transistor by a differential voltage Vdata from the voltage Vref, the following relational equation can be obtained. Thus, in this case, effect of the threshold voltage Vth of the driving transistor can be avoided. Thus variation in light emission luminance due to variation in the threshold voltage Vth can be prevented.

$$Ids = \frac{\beta}{2} \times \left(Vdata - \left(Iref \times \frac{2}{\beta}\right)^{1/2}\right)^2 \tag{4}$$

Incidentally, the following relational equation can be obtained when Iref=0. It is thus possible to avoid the effect of the threshold voltage Vth of the driving transistor and prevent degradation in image quality also when Iref=0. Incidentally, when Iref=0, a current source of the current Iref does not need to be provided, and thus the constitution can be simplified.

$$Ids = \frac{\beta}{2} \times Vdata^2 \tag{5}$$

The constitution disclosed in Japanese Patent Laid-Open No. 2007-310311 corrects variation in the threshold voltage of the driving transistor on the basis of this correcting principle. FIG. 22 is a block diagram showing an image display device to which the method disclosed in Japanese Patent Laid-Open No. 2007-310311 is applied. The image display device 1 has a display section 2 formed on a transparent insulating substrate such as glass or the like. The image display device 1 has a signal line driving circuit 3 and a scanning line driving circuit 4 formed on the periphery of the display section 2.

The display section 2 is formed by arranging pixel circuits 5R, 5G, and 5B for red, green, and blue in the form of a matrix. The signal line driving circuit 3 outputs a driving signal Ssig indicating light emission luminance to signal lines sigR, sigG, and sigB provided to the display section 2. More specifically, the signal line driving circuit 3 sequentially latches image data D1 input in order of raster scanning, for example, distributes the image data D1 to the signal lines sigR, sigG, and sigB, and then subjects each piece of the distributed data to digital-to-analog conversion processing to generate the driving signal Ssig. The image display device 1 sets the gradations of the respective pixel circuits 5R, 5G, and 5B on a so-called line-sequential basis, for example.

The scanning line driving circuit 4 outputs a writing signal WS and a driving signal DS to respective scanning lines VSCAN1 and VSCAN2 provided to the display section 2. The writing signal WS performs on-off control on writing transistors disposed in the pixel circuits 5R, 5G, and 5B. The driving signal DS controls the drain voltage of driving transistors disposed in the pixel circuits 5R, 5G, and 5B. The scanning line driving circuit 4 generates the writing signal WS and the driving signal DS by processing a timing signal output from a timing generator not shown in the figure in scanners 6A and 6B. Incidentally, references R, G, and B will hereinafter be set as appropriate as references of the signal lines sig and the driving signals Ssig of the signal lines sig to indicate correspondence with the pixel circuits 5R, 5G, and 5B for red, green, and blue. In addition, numbers in parentheses and references as references of the signal lines sig and the driving signals Ssig of the signal lines sig, references of the scanning lines VSCAN1 and VSCAN2, and the like indicate order from the side of a raster scanning start end as appropriate.

FIG. 23 is a diagram showing in detail a constitution of a pixel circuit 5R for red. Incidentally, pixel circuits 5G and 5B for green and blue are formed in the same manner as the pixel circuit 5R for red except for the colors of light emission by organic EL elements. Hence, as appropriate, the constitution of only the pixel circuit 5R for red will be described in the following, and repeated description will be omitted.

In the pixel circuit 5R, the cathode of an organic EL element 8 is connected to a predetermined fixed voltage Vss1. In addition, in the pixel circuit 5R, the anode of the organic EL element 8 is connected to the source of a driving transistor Tr3. Incidentally, the driving transistor Tr3 is an N-channel type transistor formed by a TFT, for example. In the pixel circuit 5R, the drain of the driving transistor Tr3 is connected to the scanning line VSCAN2. The pixel circuit 5R thereby current-drives the organic EL element 8 using the driving transistor Tr3 of a source follower circuit configuration.

The pixel circuit 5R has a storage capacitor Cs between the gate and the source of the driving transistor Tr3. The pixel circuit 5R sets the gate side terminal voltage of the storage capacitor Cs to a voltage according to the driving signal Ssig by a writing signal WS. As a result, the pixel circuit 5R current-drives the organic EL element 8 by the driving transistor Tr3 according to a gate-to-source voltage Vgs corresponding to the driving signal Ssig. Incidentally, a capacitance Coled in FIG. 23 is the stray capacitance of the organic EL element 8. Suppose in the following that the capacitance Coled is sufficiently larger than the capacitance of the storage capacitor Cs. In addition, suppose that the parasitic capacitance of the gate node of the driving transistor Tr3 is sufficiently smaller than the capacitance of the storage capacitor Cs.

Specifically, in the pixel circuit 5R, the gate of the driving transistor Tr3 is connected to the signal line sig via a writing transistor Tr1, which performs on-off operation according to the writing signal WS. The signal line driving circuit 3 in this case outputs the driving signal Ssig by selecting a gradation setting voltage Vsig and a voltage Vofs for threshold voltage correction in predetermined timing via switch circuits 9 and 10, which perform on operation according to predetermined control signals SELsig and SELofs, respectively.

Incidentally, the fixed voltage Vofs for threshold voltage correction is a predetermined fixed voltage used to correct variation in the threshold voltage of the driving transistor Tr3. The gradation setting voltage Vsig indicates the light emission luminance of each pixel, and is a result of adding the correcting voltage Vofs to a gradation voltage Vdata. The gradation voltage Vdata is generated by subjecting image data to digital-to-analog conversion processing, and corresponds to the light emission luminance of the pixel circuits 5R, 5G, and 5B connected to the respective signal lines sig.

As indicated by "light emission" in a driving state (FIG. 24G), the pixel circuit 5R sets the writing transistor Tr1 in an off state by the writing signal WS for a period that the organic EL element 8 is made to emit light (which period will hereinafter be referred to as an emission period). The pixel circuit 5R supplies a power supply voltage VDDV2 to the driving transistor Tr3 by a driving signal DS for power supply during the emission period. The pixel circuit 5R thereby makes the organic EL element 8 emit light by a driving current Ids corresponding to the gate-to-source voltage Vgs determined by the gate voltage Vg and the source voltage Vs (FIGS. 24E and 24F) of the driving transistor Tr3, the gate-to-source voltage Vgs being a voltage across the storage capacitor Cs, during the emission period (see Equation (1)).

The pixel circuit 5R lowers the driving signal DS for power supply to a predetermined fixed voltage VSSV2 at time point t0 at which the emission period ends. The fixed voltage VSSV2 in this case is low enough to make the drain of the driving transistor Tr3 function as a source, and is lower than the cathode voltage Vss1 of the organic EL element 8. Thereby, in the pixel circuit 5R, a charge accumulated at the terminal on the organic EL element 8 side of the storage capacitor Cs is discharged to the scanning line VSCAN2 via the driving transistor Tr3. As a result, in the pixel circuit 5R, the source voltage Vs of the driving transistor Tr3 is lowered to the voltage VSSV2, and the light emission of the organic EL element 8 is stopped.

At next predetermined time point ti, the pixel circuit 5R sets the switch circuit 10 on the fixed voltage Vofs side to an on state. As a result, in the pixel circuit SR, the signal line sig is set to the fixed voltage Vofs (FIG. 24C). The pixel circuit 5R thereafter changes the writing transistor Tr1 to an on state by the writing signal WS (FIG. 24A). The pixel circuit 5R thereby sets the gate voltage Vg of the driving transistor Tr3 to the fixed voltage Vofs. Incidentally, the fixed voltage Vofs is a voltage such that the driving transistor Tr3 is not turned on after threshold voltage correction to be described later. Specifically, letting Vtholed be the threshold voltage of the organic EL element 8, the fixed voltage Vofs needs to satisfy the following relational equation.

$$Vofs < VSS1 + Vtholed + Vth \quad (6)$$

The pixel circuit 5R thereby sets the gate-to-source voltage Vgs of the driving transistor Tr3 to Vofs−VSSV2. The pixel circuit 5R sets the voltage Vofs−VSSV2 larger than the threshold voltage Vth of the driving transistor Tr3 by setting the fixed voltages Vofs and VSSV2.

The pixel circuit 5R thereafter raises the drain voltage of the driving transistor Tr3 to the power supply voltage VDDV2 by the driving signal DS at time point t2 (FIGS. 24A to 24C). Thereby, in the pixel circuit 5R, a charge current flows in from the power supply VDDV2 to the terminal on the organic EL element 8 side of the storage capacitor Cs via the driving transistor Tr3. As a result, in the pixel circuit 5R, the voltage Vs of the terminal on the organic EL element 8 side rises gradually. Incidentally, in this case, because the fixed voltage Vofs is set in the pixel circuit 5R so as to satisfy Equation (6), the current flowing in via the driving transistor Tr3 is used only to charge the capacitance Coled of the organic EL element 8 and the storage capacitor Cs. As a result, in the pixel circuit 5R, only the source voltage Vs of the driving transistor Tr3 rises without the organic EL element 8 emitting light.

In the pixel circuit 5R, when a potential difference across the storage capacitor Cs becomes the threshold voltage Vth of the driving transistor Tr3, the inflow of the current via the driving transistor Tr3 stops. Hence, in this case, the source voltage Vs of the driving transistor Tr3 stops rising when the potential difference across the storage capacitor Cs becomes the threshold voltage Vth of the driving transistor Tr3. Thereby the pixel circuit 5R sets the potential difference across the storage capacitor Cs to the threshold voltage Vth of the driving transistor Tr3.

At time point t3 after the passage of a sufficient time to set the potential difference across the storage capacitor Cs to the threshold voltage Vth of the driving transistor Tr3, the pixel circuit 5R changes the writing transistor Tr1 to an off state by the writing signal WS (FIG. 24A). The pixel circuit 5R thereby sets the potential difference across the storage capacitor Cs to the threshold voltage Vth of the driving transistor Tr3 in a period from time point t2 to time point t3.

The pixel circuit 5R next sets the switch circuit 10 on the fixed voltage Vofs side to an off state, and thereafter sets a switch circuit 9 on the gradation setting voltage Vsig side to an on state (FIGS. 24C and 24D). The pixel circuit 5R thereby sets the voltage of the signal line sig to the gradation setting voltage Vsig. In addition, the pixel circuit 5R sets the writing transistor Tr1 in an on state at next time point t4. Thereby, in the pixel circuit 5R, the gate voltage Vg of the driving transistor Tr3 gradually rises from the state in which the potential difference across the storage capacitor Cs is set at the threshold voltage Vth of the driving transistor Tr3, and the gate voltage Vg of the driving transistor Tr3 is set to the gradation setting voltage Vsig. As a result, as described above with reference to Equation (6), the pixel circuit 5R sets the gate-to-source voltage Vgs of the driving transistor Tr3 to a differential voltage Vdata from a voltage Vref. As a result, the pixel circuit 5R can prevent variation in driving current Ids due to variation in the threshold voltage Vth of the driving transistor Tr3, and thus prevent variation in light emission luminance.

With the drain voltage of the driving transistor Tr3 retained at the power supply voltage VDDV2, the pixel circuit 5R connects the gate of the driving transistor Tr3 to the signal line sig for a fixed period Tμ, and thereby sets the gate voltage of the driving transistor Tr3 to the gradation setting voltage Vsig. Thereby the pixel circuit 5R also corrects variation in mobility μ of the driving transistor Tr3.

A writing time constant required for the rise in the gate voltage Vg of the driving transistor Tr3 which rise is performed via the writing transistor Tr1 is set shorter than a time constant required for a rise in the source voltage Vs of the driving transistor Tr3. Suppose in the following description that the writing time constant is so short as to be negligible as compared with the time constant required for a rise in the source voltage Vs.

In this case, when the writing transistor Tr1 performs on operation, the gate voltage Vg of the driving transistor Tr3 quickly rises to the gradation setting voltage Vsig (Vofs+Vdata). At the time of the rising of the gate voltage Vg, when the capacitance Coled of the organic EL element 8 is sufficiently larger than the capacitance of the storage capacitor Cs, the source voltage Vs of the driving transistor Tr3 does not vary.

However, when the gate-to-source voltage Vgs of the driving transistor Tr3 is increased to be higher than the threshold voltage Vth, a current Ids flows in from the power supply VDDV2 via the driving transistor Tr3, and the source voltage Vs of the driving transistor Tr3 rises gradually. As a result, in the pixel circuit 5R, the voltage across the storage capacitor Cs is discharged by the driving transistor Tr3, and the rising speed of the gate-to-source voltage Vgs is lowered.

A discharge speed at this time changes according to the capability of the driving transistor Tr3. More specifically, the higher the mobility μ of the driving transistor Tr3, the faster the discharge speed. That is, the driving current Ids of the driving transistor Tr3 that determines the discharge speed can be expressed by the following equation.

$$Ids = \frac{\beta}{2} \times \left( \frac{1}{Vdata} + \frac{\beta}{2} \times \frac{T_\mu}{C} \right)^{-2} \tag{7}$$

$$C = Cs + Coled$$

As a result, in the pixel circuit 5R, the potential difference across the storage capacitor Cs is set so as to be lowered as the mobility μ of the driving transistor Tr3 is increased. Thus variation in light emission luminance due to variation in mobility is prevented. After the passage of the period Tμ, the pixel circuit 5R lowers the writing signal WS, and changes the switch circuit 9 on the gradation setting voltage Vsig side to an off state. As a result, the pixel circuit 5R starts an emission period, and makes the organic EL element 8 emit light by the driving current corresponding to the voltage across the storage capacitor Cs. Incidentally, at this time, the power supply voltage VDDV2 needs to be set such that the driving transistor Tr3 performs saturation operation. More specifically, the power supply voltage VDDV2 needs to be set such that VDDV2>VEL+(Vgs−Vth).

Heretofore, a method has been proposed which reduces the number of output terminals of a data driver, which is an integrated circuit for generating the above-described gradation voltage Vdata, by driving signal lines on a time division basis, with an objective of reducing connecting parts of the data driver in the signal line driving circuit of a liquid crystal image display device.

It is therefore considered that the image display device described with reference to FIG. 23 can also adopt this system to be simplified in constitution. For this, it is considered that the output stage of a signal line driving circuit 13 is formed as shown in FIG. 25. Specifically, in FIG. 25, the signal line driving circuit 13 inputs a fixed voltage Vofs for threshold voltage correction to signal lines sigR, sigG, and sigB via switch circuits 10R, 10G, and 10B, respectively. The signal line driving circuit 13 in this case makes the three switch circuits 10R, 10G, and 10B simultaneously perform on operation by a control signal SELofs. The signal line driving circuit 13 thereby simultaneously sets the potential of the signal lines connected to the pixel circuits 5R, 5G, and 5B to the fixed voltage Vofs. In addition, in synchronism with the setting of the fixed voltage Vofs, the pixel circuits 5R, 5G, and 5B make the writing transistor Tr1 perform on-off operation, and temporarily raise the driving signal DS. The pixel circuits 5R, 5G, and 5B thereby simultaneously set the potential difference across the storage capacitor Cs to the threshold voltage Vth of the driving transistor Tr3 (FIG. 26D).

The signal line driving circuit 13 also inputs the output signal sigin of a data driver 12 to the signal lines sigR, sigG, and sigB of the pixel circuits 5R, 5G, and 5B for red, green, and blue via switch circuits 9R, 9G, and 9B, respectively. As shown in FIG. 26E, the output signal sigin of the data driver 12 is generated by time-division-multiplexing gradation setting voltages Vsig to be output to the three pixel circuits 5R, 5G, and 5B. The signal line driving circuit 13 makes the switch circuits 9R, 9G, and 9B sequentially perform on operation by control signals SELsigR, SELsigG, and SELsigB (FIGS. 26A to 26C). The signal line driving circuit 13 thereby distributes and outputs the output signal sigin to the corresponding signal lines sigR, sigG, and sigB (FIGS. 26F to 26H).

In correspondence with the driving of the signal lines sigR, sigG, and sigB, the pixel circuits 5R, 5G, and 5B sequentially make the writing transistor Tr1 perform on operation to set the gate voltage of the driving transistor Tr3 to the gradation setting voltage Vsig. According to the constitution of FIG. 25, the number of output terminals of the data driver 12 can be reduced to ⅓ of the number of signal lines provided in the display section. Therefore the constitution can be simplified.

However, the image display device of organic EL elements needs to make the writing transistor Tr1 perform on operation and greatly raise the gate voltage Vg of the driving transistor Tr3 from the fixed voltage Vofs to the gradation setting voltage VsigR, VsigG, or VsigB. Incidentally, in FIGS. 26F to 26H, the voltage rises are indicated by a reference ΔVwr. Consequently, in order to set the gate voltage Vg of the driving transistor Tr3 to the gradation setting voltage VsigR, VsigG, or VsigB with high precision, the image display device needs a certain time after making the writing transistor Tr1 perform on operation.

Thus, in the case where the signal line driving circuit 13 of FIG. 25 drives the three signal lines on a time division basis, it is difficult to set the gate voltage Vg of the driving transistor Tr3 to the gradation setting voltage VsigR, VsigG, or VsigB with high precision when the number of lines of the display section is increased due to an increase in precision. Incidentally, when the terminal voltage of the storage capacitor Cs thus cannot be set to the gradation setting voltage VsigR, VsigG, or VsigB with high precision, it becomes difficult to represent a gradation correctly, which causes degradation in image quality.

Even in a case of low resolution, it is similarly difficult to set the gate voltage Vg of the driving transistor Tr3 to the gradation setting voltage VsigR, VsigG, or VsigB with high precision when the number of signal lines driven by time division is increased. Thus, in this case, it is difficult to reduce the number of terminals of the data driver, and it is difficult to simplify the constitution.

SUMMARY OF THE INVENTION

The present invention has been made in view of the above, and is to propose an image display device and a driving method of the image display device that can set the gate voltage of a driving transistor with high precision even when a plurality of signal lines are driven on a time division basis in the image display device, which drives a self-luminous element by the driving transistor.

According to an embodiment of the present invention, there is provided an image display device for displaying input image data on a display section formed by arranging pixel circuits in a form of a matrix by driving the pixel circuits by a signal line driving circuit and a scanning line driving circuit via a signal line and a scanning line of the display section. In the image display device, the pixel circuits each include at least a light emitting element, a driving transistor configured to current-drive the light emitting element by a driving current corresponding to a gate-to-source voltage, a storage capacitor configured to retain the gate-to-source voltage, and a writing transistor configured to set a voltage across the storage capacitor by a voltage of the signal line. And the signal line driving circuit includes a data driver configured to time-division-multiplex and output gradation setting voltages for each unit of a plurality of signal lines after assigning the input image data to the signal lines and generating, for each of the signal lines, the gradation setting voltages sequentially indicating gradations of the pixel circuits connected to the respective signal lines, a switch circuit for the gradation setting voltages, the switch circuit for the gradation setting voltages distributing an output signal of the data driver to the plurality of signal lines, and a switch circuit for precharge, the switch circuit for precharge setting at least potential of the corresponding signal lines to a precharge voltage in advance when voltage of the signal lines is set to the gradation setting voltages.

In addition, according to an embodiment of the present invention, there is provided a driving method of an image display device for displaying input image data on a display section formed by arranging pixel circuits in a form of a matrix by driving the pixel circuits by a signal line driving circuit and a scanning line driving circuit via a signal line and a scanning line of the display section, the pixel circuits each including at least a light emitting element, a driving transistor configured to current-drive the light emitting element by a driving current corresponding to a gate-to-source voltage, a storage capacitor configured to retain the gate-to-source voltage, and a writing transistor configured to set a voltage across the storage capacitor by a voltage of the signal line. The driving method of the image display device includes: a data driver processing step of outputting an output signal obtained by time-division-multiplexing gradation setting voltages for each unit of a plurality of signal lines from a data driver after assigning the input image data to the signal lines and generating, for each of the signal lines, the gradation setting voltages sequentially indicating gradations of the pixel circuits connected to the respective signal lines; a gradation setting voltage distributing step of distributing and outputting the output signal of the data driver to the plurality of signal lines; and a precharge step of setting at least potential of the corresponding signal lines to a precharge voltage in advance when voltage of the signal lines is set to the gradation setting voltages by the gradation setting voltage distributing step.

According to the constitution of the above-described embodiments, the potential of the signal lines is set to a precharge voltage in advance, and thereafter the gradation setting voltages are set. Thereby a time taken to set the gradation setting voltages can be shortened as compared with the case of directly setting the gradation setting voltages. Thus, the gate voltage of a driving transistor can be set with high precision even when a plurality of signal lines are driven on a time division basis.

According to the present invention, the gate voltage of a driving transistor can be set with high precision even when a plurality of signal lines are driven on a time division basis in an image display device that drives a self-luminous element by the driving transistor.

DETAILED DESCRIPTION OF PREFERRED EMBODIMENTS

Preferred embodiments of the present invention will hereinafter be described in detail with reference to the drawings as appropriate.

First Embodiment (1) Configuration of First Embodiment

Figure 1:
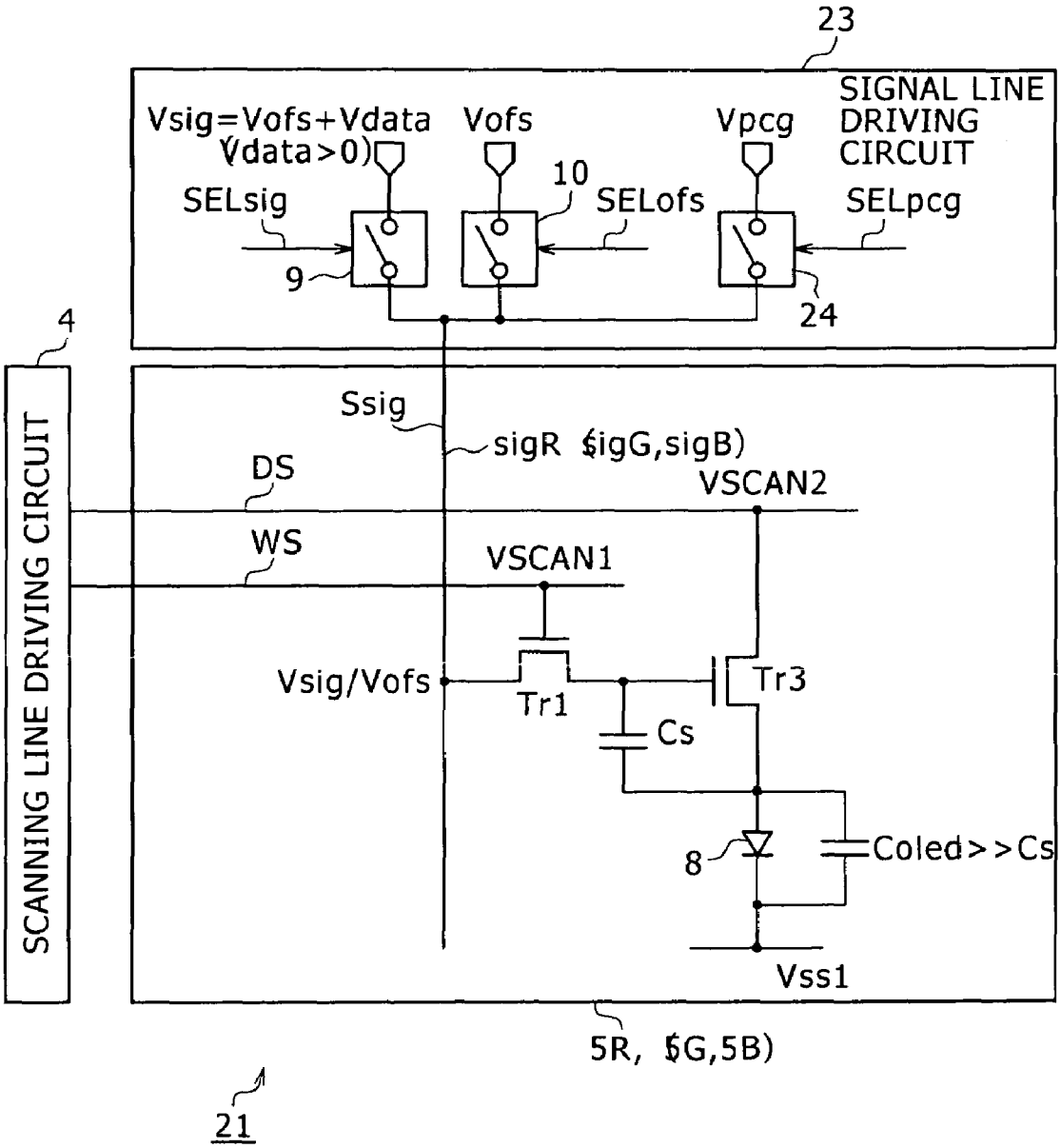
FIG. 1 is a diagram showing an image display device according to a first embodiment of the present invention.
Figure 23:
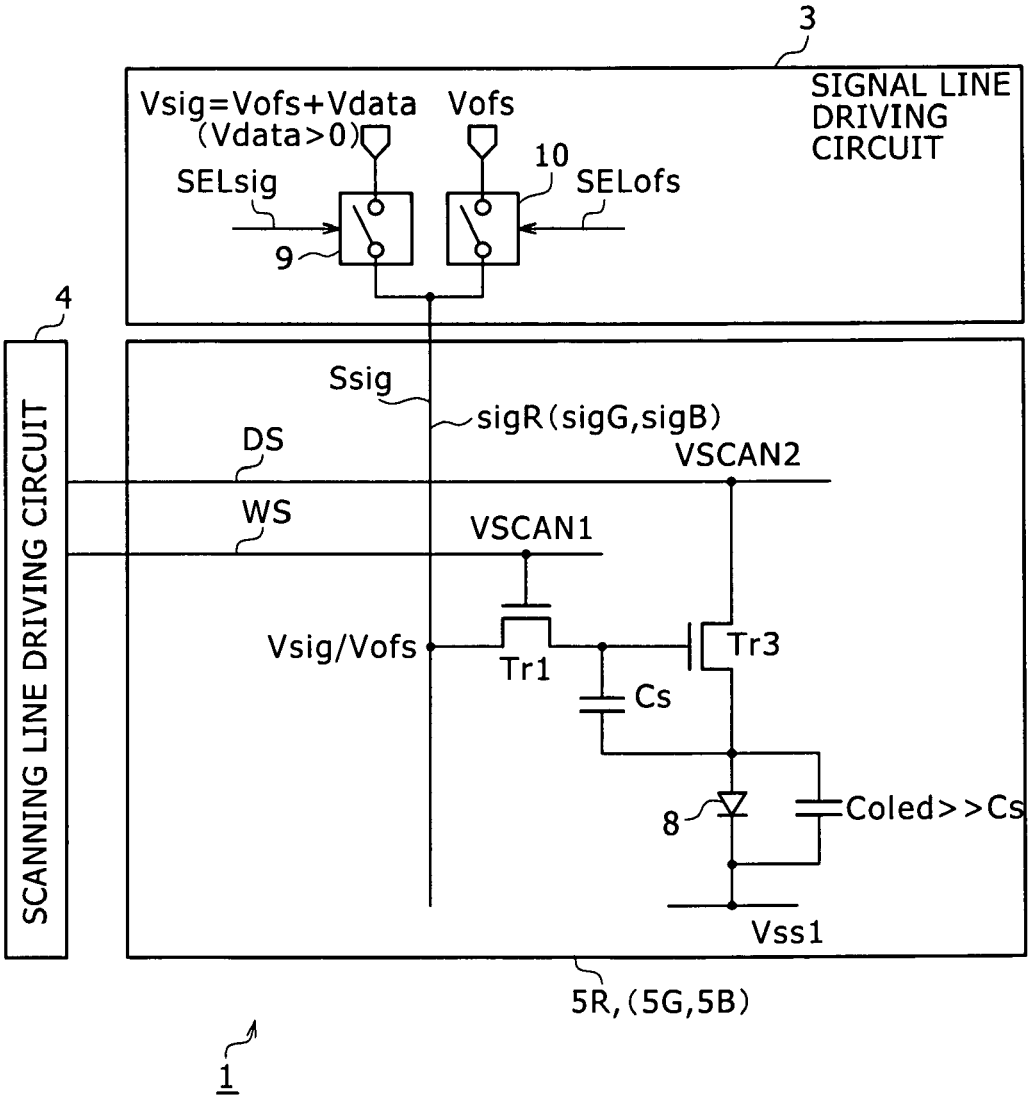
FIG. 23 is a diagram showing in detail a pixel circuit in the image display device of FIG. 22.
Figures 24A, 24B, 24C, 24D, 24E, 24F, 24G:
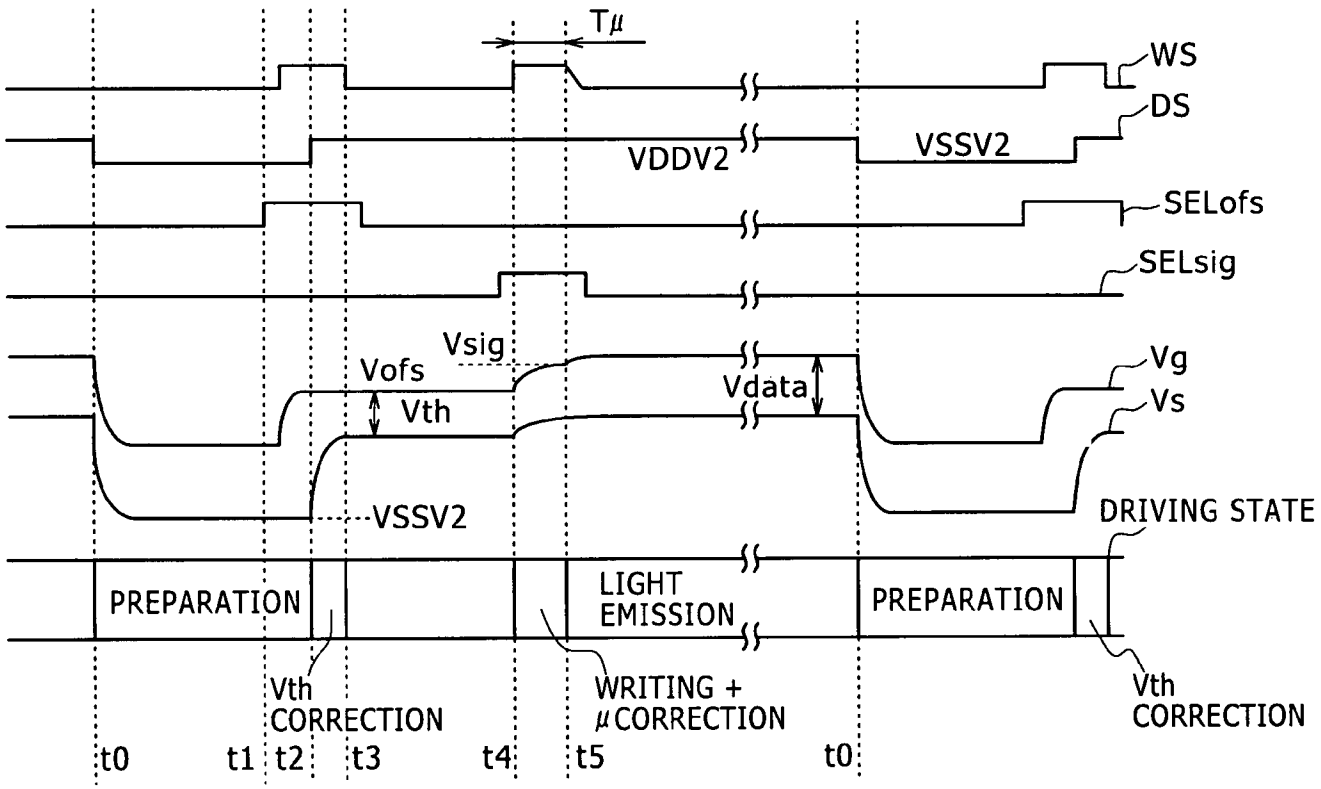
FIG.24G PRIOR ART
FIGS. 24A to 24G are time charts of assistance in explaining the operation of the pixel circuit of FIG. 23.

FIG. 1 is a diagram showing an image display device according to a first embodiment of the present invention by contrast with FIG. 23. The image display device 21 according to the present embodiment is formed in the same manner as the above-described image display device 1 except that the image display device 21 is provided with a signal line driving circuit 23 in place of the signal line driving circuit 3.

The signal line driving circuit 23 in this case is configured to be able to output a voltage Vsig for setting a gradation, a fixed voltage Vofs for threshold voltage correction, and a precharge voltage Vpcg selectively to a signal line sig via switch circuits 9, 10, and 24, respectively. The precharge voltage Vpcg in this case is to raise the potential of the signal line sig in advance before setting the gate voltage Vg of a driving transistor Tr3 to the gradation setting voltage Vsig. The precharge voltage Vpcg is set to a voltage between a maximum value and a minimum value of the gradation setting voltage Vsig. Incidentally, the precharge voltage Vpcg is desirably an intermediate value between the maximum value and the minimum value of the gradation setting voltage Vsig ((Maximum value+Minimum value)/2). Thus, the precharge voltage Vpcg in the present embodiment is set to the intermediate value between the maximum value and the minimum value of the gradation setting voltage Vsig.

Figures 2A, 2B, 2C, 2D, 2E, 2F, 2G, 2H:
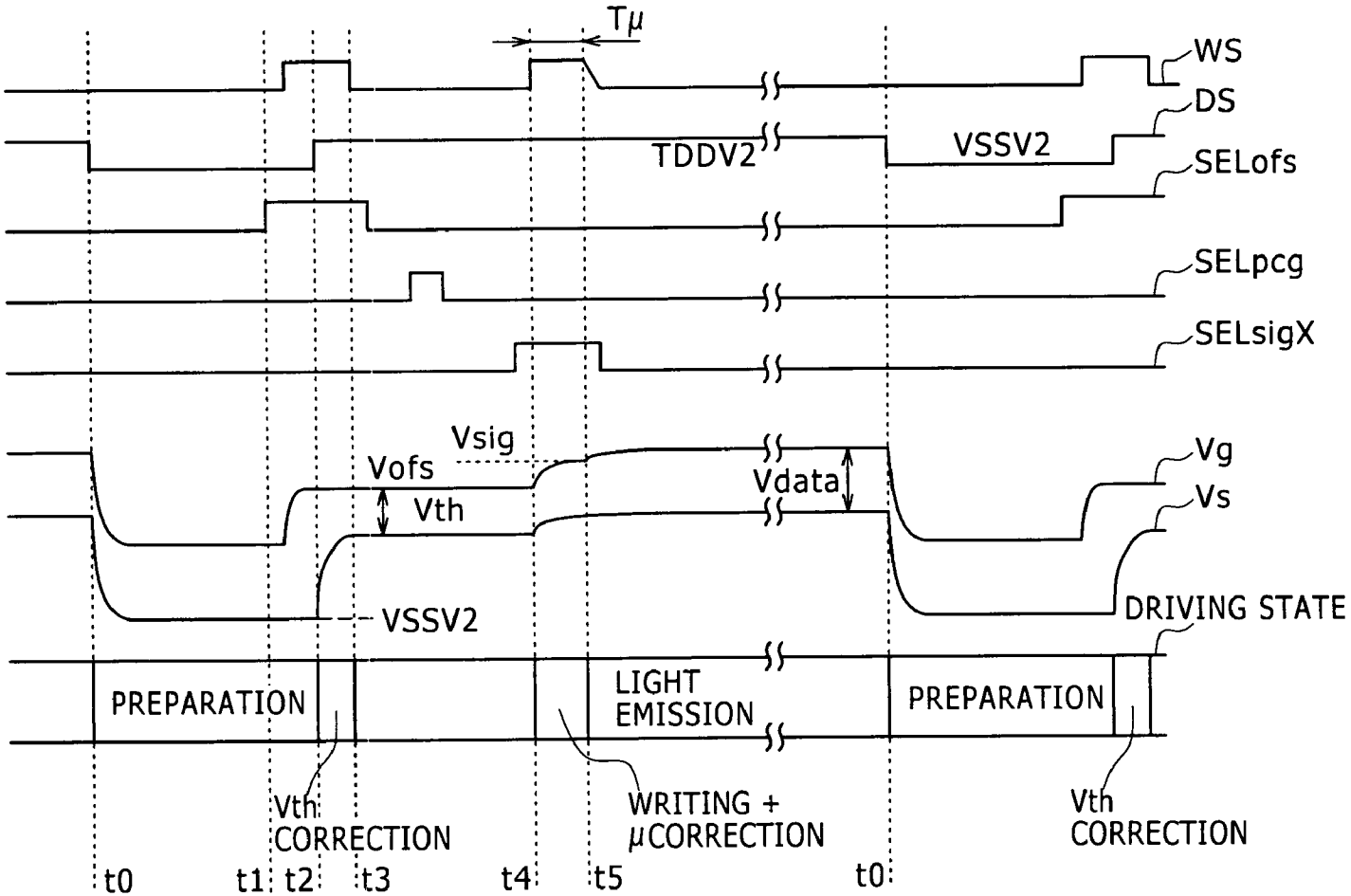
FIGS. 2A to 2H are time charts of assistance in explaining the operation of a pixel circuit in the image display device of FIG. 1.

As shown in FIGS. 2A to 2H by contrast with FIGS. 24A to 24G, a pixel circuit 5R sets a potential difference across a storage capacitor Cs to the threshold voltage Vth of the driving transistor Tr3 by a writing signal WS (FIGS. 2A to 2C and 2F and 2G), and thereafter changes the switch circuit 24 to an on state in predetermined timing by a driving signal SELpcg (FIG. 2D). The image display device 21 thereby precharges the signal line sig to raise the potential of the signal line sig to the precharge voltage Vpcg in advance before setting the gate voltage Vg of the driving transistor Tr3 to the gradation setting voltage Vsig.

The pixel circuit 5R thereafter sets the gate voltage Vg of the driving transistor Tr3 to the gradation setting voltage Vsig by the writing signal WS (FIGS. 2E to 2H).

The image display device 21 sets a plurality of signal lines sig to the gradation setting voltage Vsig on a time division basis. The image display device 21 raises the potential of the plurality of signal lines sig to be set to the gradation setting voltage Vsig on a time division basis to the precharge voltage Vpcg simultaneously and in parallel with each other.

Figure 3:
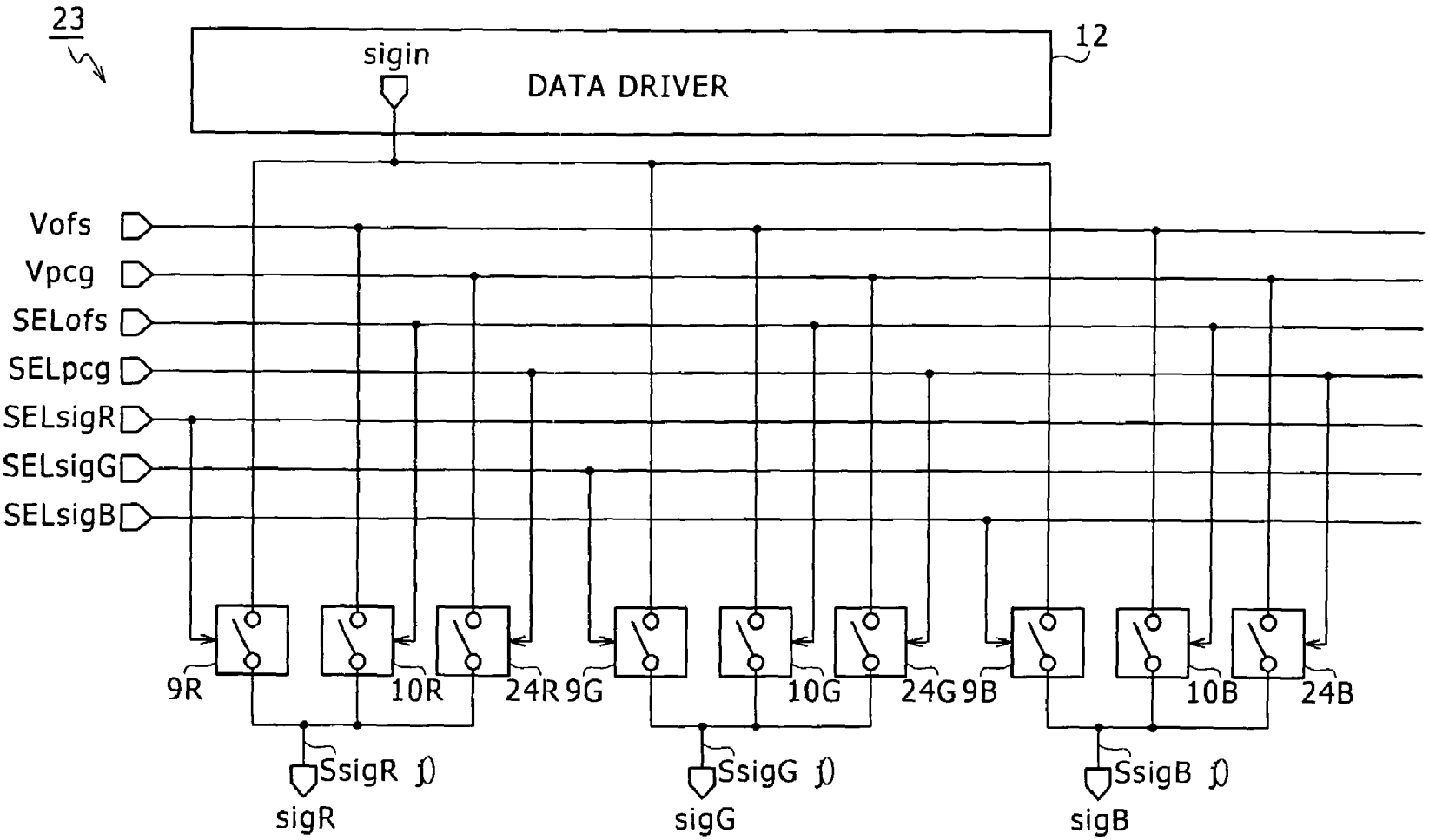
FIG. 3 is a connection diagram showing an output stage of a signal line driving circuit in the image display device of FIG. 1.
Figure 25:
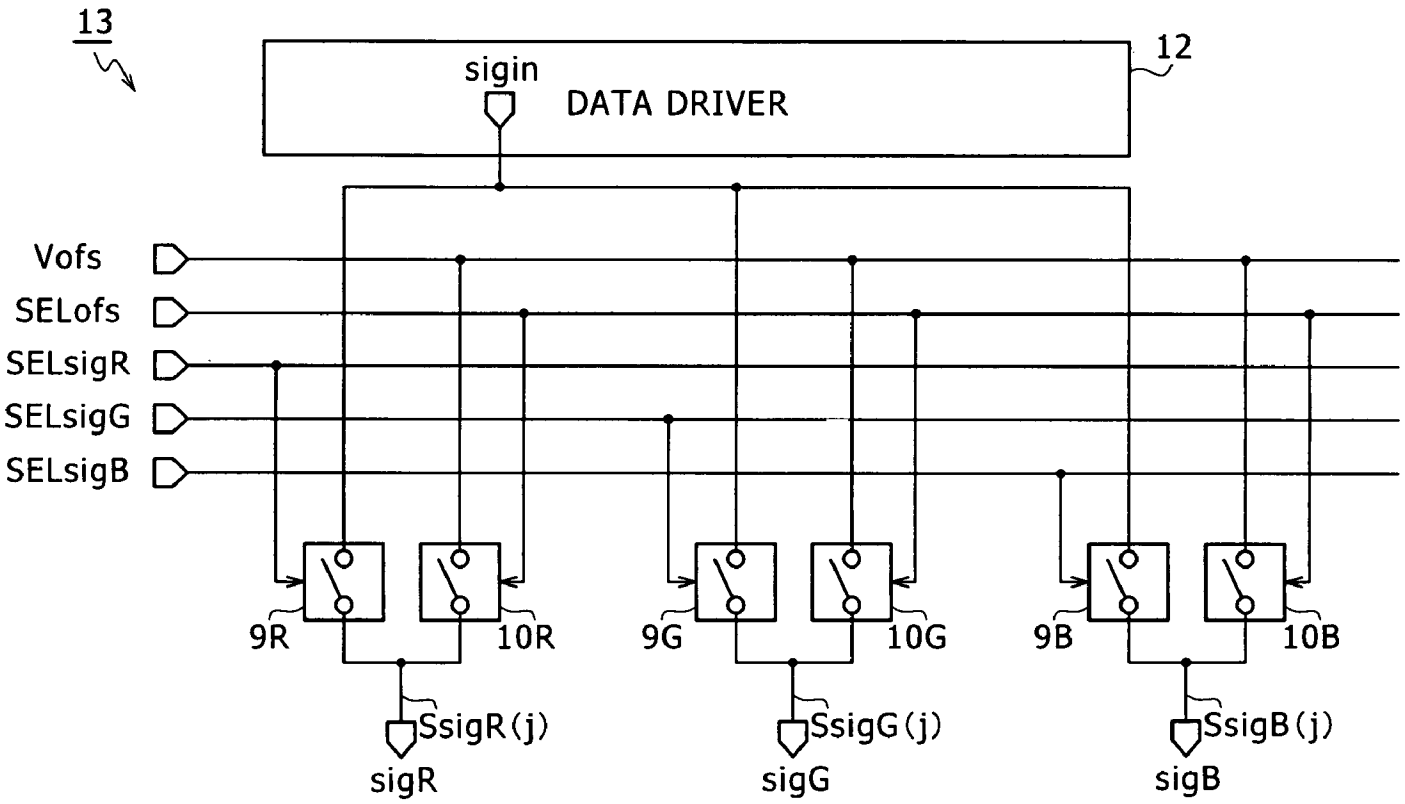
FIG. 25 is a diagram showing a configuration in a case where a plurality of signal lines are driven on a time division basis.
Figures 26A, 26B, 26C, 26D, 26E, 26F, 26G, 26H:
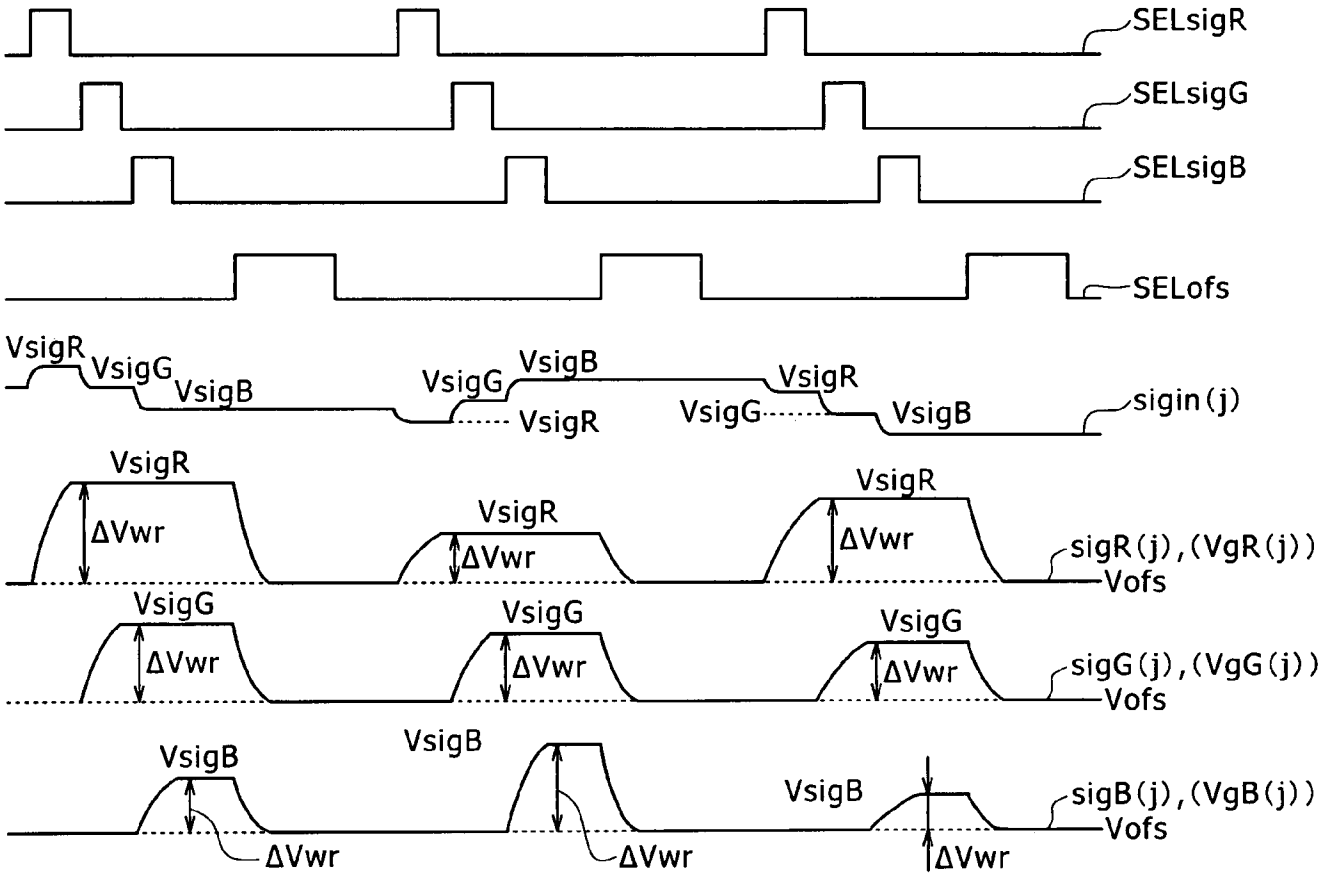
FIG.26H PRIOR ART
FIGS. 26A to 26H are time charts of assistance in explaining the operation of the configuration of FIG. 25.

FIG. 3 is a diagram showing a configuration of the signal line driving circuit 23 by contrast with FIG. 25. The signal line driving circuit 23 is formed in the same manner as the signal line driving circuit 13 in FIG. 25 except that the signal line driving circuit 23 has a different configuration with respect to the switch circuit 24 (24R, 24G, and 24B). The signal line driving circuit 23 supplies the signal lines sigR, sigG, and sigB of pixel circuits 5R, 5G, and 5B for red, green, and blue which circuits are driven by time division with a control signal SELpcg common to the switch circuits 24 (24R, 24G, and 24B) so as to be able to commonly control the switch circuits 24 (24R, 24G, and 24B).

Figures 4A, 4B, 4C, 4D, 4E, 4F, 4G, 4H, 4I:
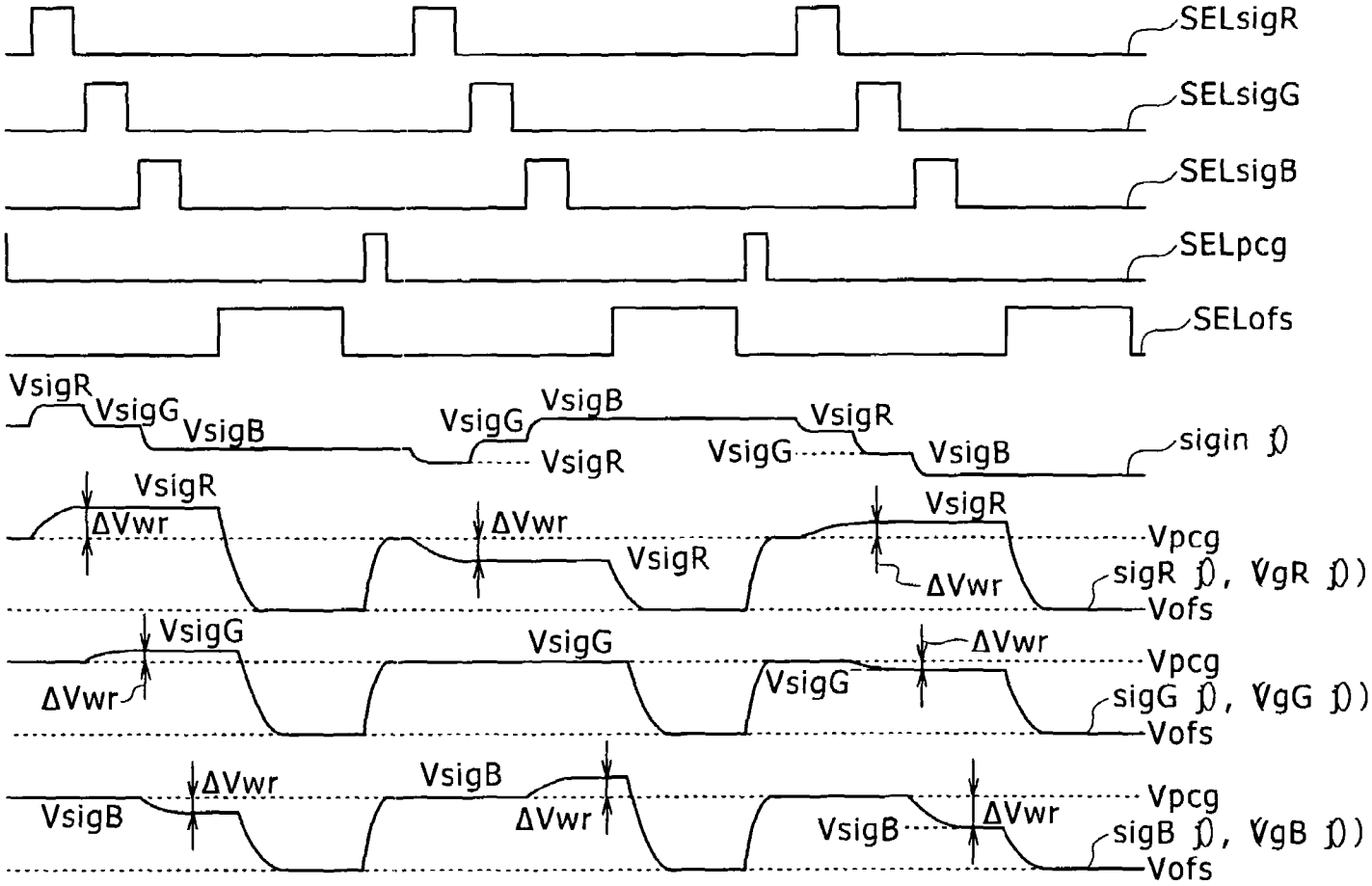
FIGS. 4A to 4I are time charts of assistance in explaining the operation of the signal line driving circuit of FIG. 3.

In this case, as shown in FIGS. 4A to 4I, the signal line driving circuit 23 makes switch circuits 10R, 10G, and 10B simultaneously perform an on operation at a predetermined point in time by a control signal SELofs (FIG. 4E). The signal line driving circuit 23 thereby sets the potential of the signal lines sigR, sigG, and sigB connected to the pixel circuits 5R, 5G, and 5B to the fixed voltage Vofs for threshold value correction (FIGS. 4G to 4I). By the setting of the fixed voltage Vofs, the pixel circuits 5R, 5G, and 5B set the potential difference across the storage capacitor Cs to the threshold voltage Vth of the driving transistor Tr3. More specifically, the pixel circuits 5R, 5G, and 5B make a writing transistor Tr1 perform an on-off operation and temporarily raise a driving signal DS in synchronism with the setting of the fixed voltage Vofs. Thereby the pixel circuits 5R, 5G, and 5B simultaneously set the potential difference across the storage capacitor Cs to the threshold voltage Vth of the driving transistor Tr3.

Next, the signal line driving circuit 23 temporarily raises a control signal SELpcg to make the switch circuits 24R, 24G, and 24B temporarily perform an on operation (FIG. 4D). The signal line driving circuit 23 thereby sets the potential of the signal lines sigR, sigG, and sigB connected to the pixel circuits 5R, 5G, and 5B to the precharge voltage Vpcg (FIGS. 4G to 4I).

Next, the signal line driving circuit 23 sequentially makes control signals SELsigR, SELsigG, and SELsigB perform an on operation (FIGS. 4A to 4C). In addition, the pixel circuits 5R, 5G, and 5B sequentially make the writing transistor Tr1 perform an on operation in such a manner as to be interlocked with the on operation of the control signals SELsigR, SELsigG, and SELsigB. Thus, the image display device 21 sets the potential of the signal lines sig to the precharge voltage Vpcg in bloc, and thereafter sequentially sets the gradations of the respective pixel circuits 5R, 5G, and 5B.

(2) Operation of First Embodiment

Figure 22:
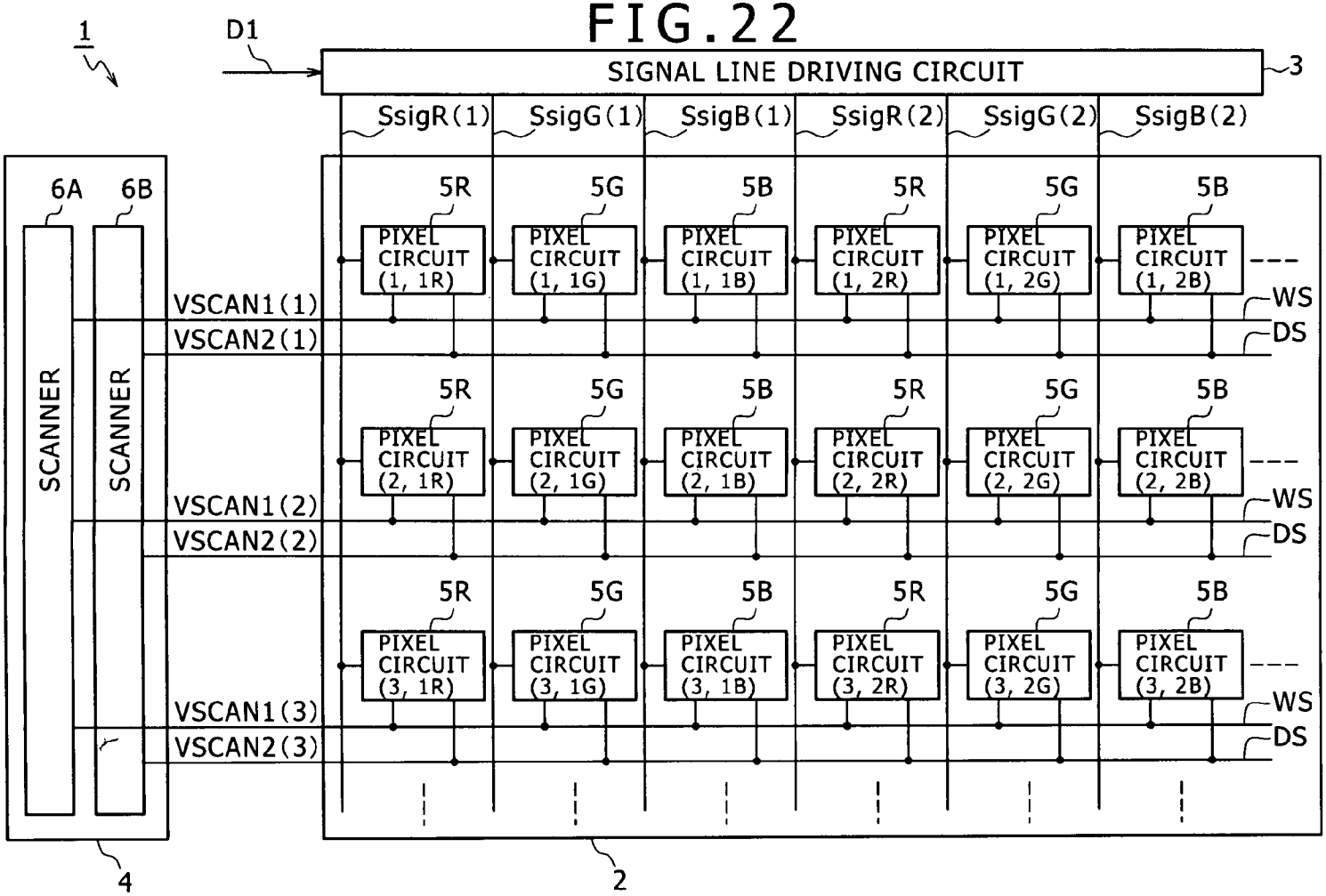
FIG. 22 is a block diagram showing an image display device in related art.

In the above configuration of the signal line driving circuit 23 in the image display device 21, sequentially input image data D1 is distributed to signal lines sig of a display section 2 (see FIG. 22), and then subjected to digital-to-analog conversion processing. Thereby the image display device 21 generates, for each signal line sig, gradation voltage Vdata indicating the gradation of each pixel connected to the signal lines sig. In the image display device 21, a scanning line driving circuit 4 drives the display section 2 to thereby set the gradation voltage Vdata in each pixel circuit 5R (5G and 5B) forming the display section 2 on a line-sequential basis, for example. Each organic EL element 8 in each pixel circuit 5R (5G and 5B) emits light at a light emission luminance corresponding to the gradation voltage Vdata (FIG. 1). The image display device 21 can thereby display an image corresponding to the image data D1 on the display section 2.

More specifically, in the pixel circuits 5R (5G and 5B), the organic EL element 8 is current-driven by the driving transistor Tr3 of a source follower circuit configuration. In the pixel circuits 5R (5G and 5B), voltage of a gate side terminal of the storage capacitor Cs disposed between the gate and the source of the driving transistor Tr3 is set to the voltage Vsig corresponding to the gradation voltage Vdata. The image display device 21 thereby makes the organic EL element 8 emit light at a light emission luminance corresponding to the image data D1 to display a desired image.

However, the driving transistor Tr3 applied to these pixel circuits 5R (5G and 5B) has a disadvantage of large variations in threshold voltage Vth. Consequently, in the image display device 21, simply setting the voltage of the gate side terminal of the storage capacitor Cs to the voltage Vsig corresponding to the gradation voltage Vdata results in variation in light emission luminance of the organic EL element 8 due to variation in threshold voltage Vth of the driving transistor Tr3, and thus degrades image quality.

Accordingly, in the image display device 21, the gate voltage of the driving transistor Tr3 is set to the predetermined fixed voltage Vofs via the writing transistor Tr1 in advance after the voltage of the terminal on the organic EL element 8 side of the storage capacitor Cs is lowered (see FIGS. 2A to 2H and FIG. 23). Thereby, in the image display device 21, the voltage across the storage capacitor Cs is set larger than the threshold voltage Vth of the driving transistor Tr3. Thereafter the voltage across the storage capacitor Cs is discharged via the driving transistor Tr3. As a result of the series of processes, in the image display device 21, the voltage across the storage capacitor Cs is set to the threshold voltage Vth of the driving transistor Tr3.

Thereafter, in the image display device 21, the gradation setting voltage Vsig obtained by adding the fixed voltage Vofs to the gradation voltage Vdata is set as the gate voltage of the driving transistor Tr3. The image display device 21 can thereby prevent degradation in image quality due to variation in the threshold voltage Vth of the driving transistor Tr3 (see Equation (6)).

In addition, degradation in image quality due to variation in mobility of the driving transistor Tr3 can be prevented by setting the gate voltage of the driving transistor Tr3 to the gradation setting voltage Vsig in a state in which power is supplied to the driving transistor Tr3 for a fixed time Tμ.

In the image display device 21, the gradation voltage Vdata is generated by a data driver 12 provided in the signal line driving circuit 23. In this case, when the data driver 12 outputs the gradation setting voltage Vsig to each signal line sig, connecting parts in mounting the data driver 12 in the image display device 21 are increased significantly. As a result, the manufacture of the image display device 21 becomes significantly complex. The configuration of the image display device 21 also becomes complex.

Accordingly, in the present embodiment, the gradation setting voltage Vsig (sigin) is output from the data driver 12 to the three pixel circuits 5R, 5G, and 5B for red, green, and blue, which circuits are adjacent to each other in a horizontal direction, by time division. In addition, when the gradation setting voltage Vsig is output from the signal line driving circuit 23, the time-divided output (sigin) is distributed to each of the signal lines sigR, sigG, and sigB (FIG. 3 and FIGS. 4A to 4I), and the gate voltage of the driving transistor Tr3 is sequentially set in each of the pixel circuits 5R, 5G, and 5B on a time division basis. Thus, in the image display device 21, the number of output terminals of the data driver 12 can be reduced to ⅓ of the number of signal lines sig. As a result, the manufacture and the configuration of the image display device 21 can be simplified.

However, when the gate voltage of the driving transistor Tr3 is thus set to the gradation setting voltage Vsig by time division, a sufficient time for setting the gate voltage of the driving transistor Tr3 to the gradation setting voltage Vsig cannot be secured in the pixel circuits 5R, 5G, and 5B due to an increase in the number of lines. As a result, the gradation of each pixel cannot be set correctly when the image display device 21 is increased in resolution. In addition, the number of output terminals of the data driver 12 cannot be reduced sufficiently. In particular, a sufficient time for correcting variation in threshold voltage of the driving transistor Tr3 as described above with reference to Equation (6) cannot be secured, and a sufficient time for correcting variation in mobility of the driving transistor Tr3 cannot be secured. As a result, when the image display device 21 is increased in resolution, the prevention of degradation in image quality by correcting various variations cannot be made sufficiently.

Accordingly, in the present embodiment, the potential of each signal line sig is set to the precharge voltage Vpcg in advance in correspondence with the process of setting the gate voltage of the driving transistor Tr3 to the gradation setting voltage Vsig by time division. That is, the signal line driving circuit 23 is configured to be able to select and output the precharge voltage Vpcg to each signal line sig via the switch circuits 24R, 24G, and 24B. In addition, the pixel circuits 5R, 5G, and 5B simultaneously set the voltage across the storage capacitor Cs to the threshold voltage Vth of the driving transistor Tr3. Thereafter the potential of the signal lines sig is simultaneously set to the precharge voltage Vpcg, and then the gate voltage of the driving transistor Tr3 is sequentially set to the gradation setting voltage Vsig. In addition, the precharge voltage Vpcg is set at a voltage between the maximum value and the minimum value of the gradation setting voltage Vsig.

Thus, the image display device 21 sets the gate voltage of the driving transistor Tr3 to the gradation setting voltage Vsig after setting the potential of the signal lines sig to the precharge voltage Vpcg in advance. Therefore the image display device 21 can correctly set the gate voltage of the driving transistor Tr3 to the gradation setting voltage Vsig in a significantly shorter time than in the case of setting the gate voltage of the driving transistor Tr3 to the gradation setting voltage Vsig directly from the fixed voltage Vofs. Thus, the gate voltage of the driving transistor can be set with high accuracy even when a plurality of signal lines are driven on a time division basis. It is also possible to secure a sufficient time for correcting variation in threshold voltage of the driving transistor Tr3 and correcting variation in mobility of the driving transistor Tr3, correct these variations with high accuracy, and thus prevent degradation in image quality.

In particular, in the present embodiment, the precharge voltage Vpcg is an intermediate voltage between the maximum value and the minimum value of the gradation setting voltage Vsig, the intermediate voltage being expressed as (Maximum value+Minimum value)/2. Thereby, when the gradation setting voltage Vsig is set to various voltages, a time taken to set the gradation setting voltage Vsig can be reduced most efficiently. Thus, in the present embodiment, the gate voltage of the driving transistor can be set with high accuracy even when a plurality of signal lines are driven on a time division basis. It is also possible to secure a sufficient time for correcting variation in threshold voltage of the driving transistor Tr3 and correcting variation in mobility of the driving transistor Tr3, correct these variations with high accuracy, and thus prevent degradation in image quality.

(3) Effect of First Embodiment

According to the above configuration, the gradation setting voltage for each pixel circuit is set by driving a plurality of signal lines on a time division basis, and the potential of the signal lines is raised to a predetermined potential in advance. Thus, the gate voltage of the driving transistor can be set with high accuracy even when the plurality of signal lines are driven on a time division basis. It is also possible to secure a sufficient time for correcting variation in threshold voltage of the driving transistor Tr3 and correcting variation in mobility of the driving transistor Tr3, correct these variations with high accuracy, and thus prevent degradation in image quality.

Further, the advance potential setting is made simultaneously in the plurality of signal lines driven by time division, so that a constitution for the potential setting can be simplified.

Further, because the predetermined potential is an intermediate voltage between the maximum value and the minimum value of the gradation setting voltage, a time taken to set the gradation setting voltage Vsig can be shortened most efficiently.

Further, the voltage across the storage capacitor is set to the threshold voltage of the driving transistor, the potential of the signal lines is then set to the precharge voltage, and thereafter the gradation setting voltage is set. Therefore degradation in image quality due to variation in threshold voltage of the driving transistor can be avoided effectively.

Second Embodiment

Figure 5:
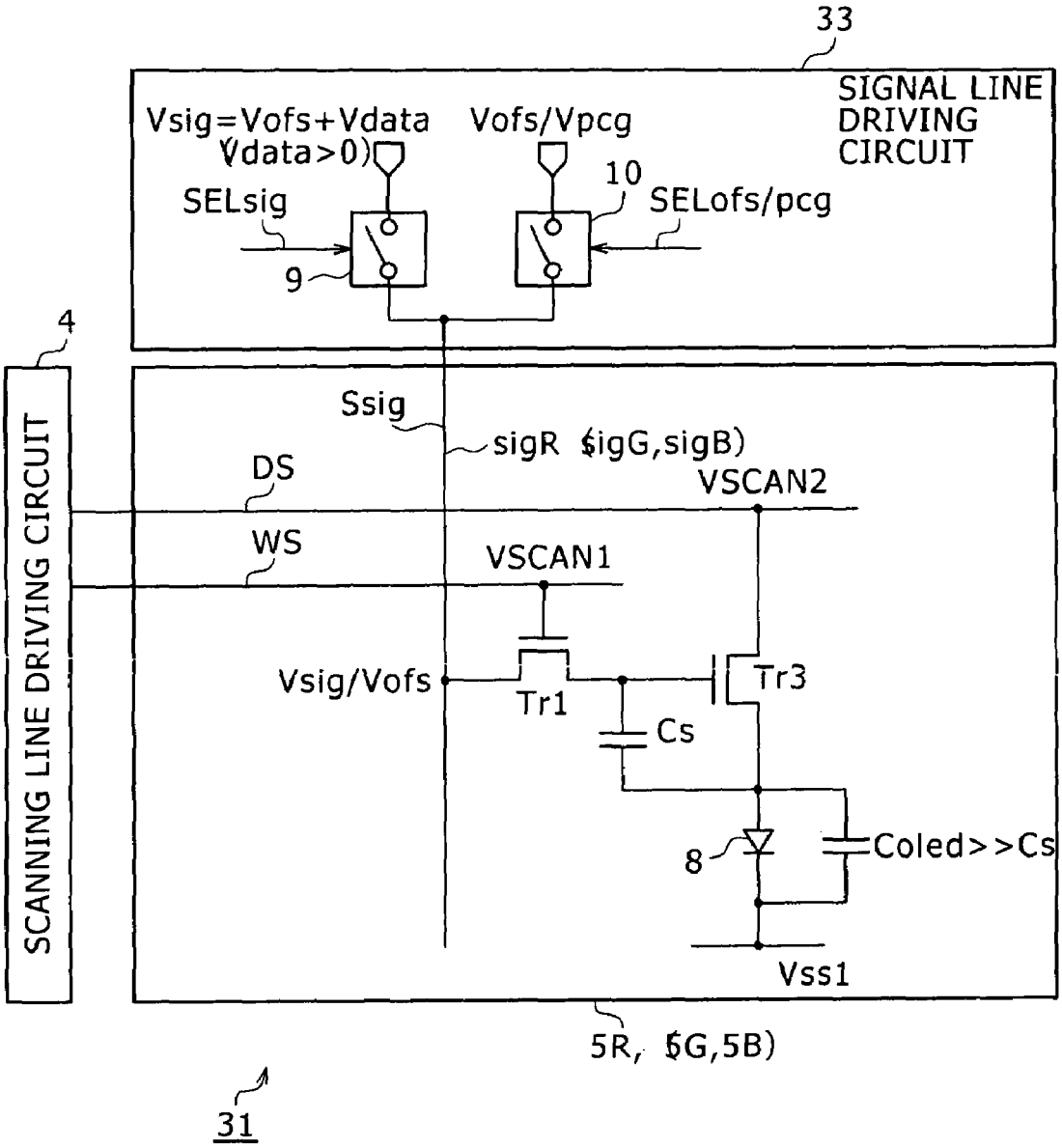
FIG. 5 is a diagram showing an image display device according to a second embodiment of the present invention.
Figures 6A, 6B, 6C, 6D, 6E, 6F, 6G, 6H:
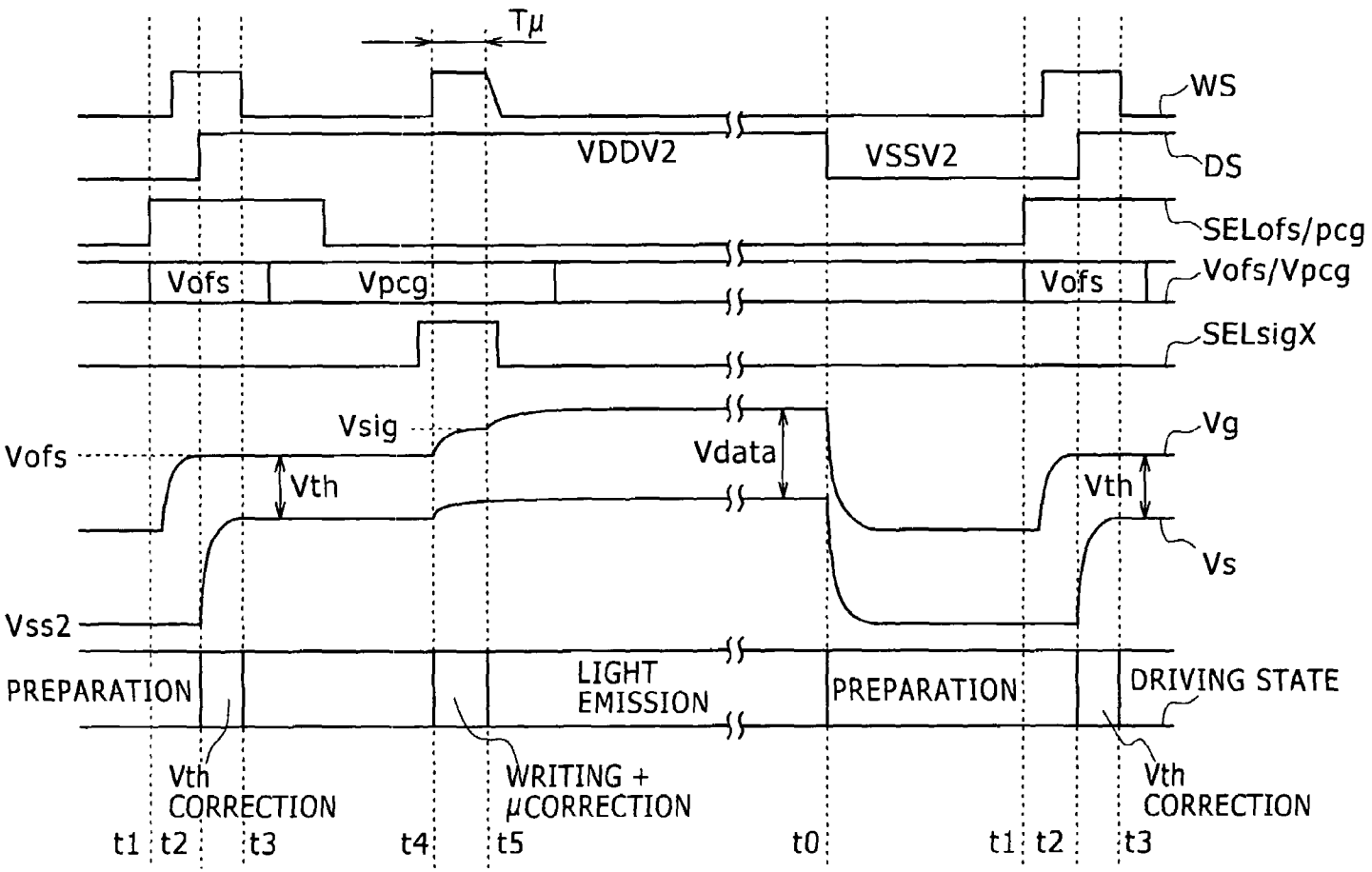
FIGS. 6A to 6H are time charts of assistance in explaining the operation of a pixel circuit in the image display device of FIG. 5.
Figure 7:
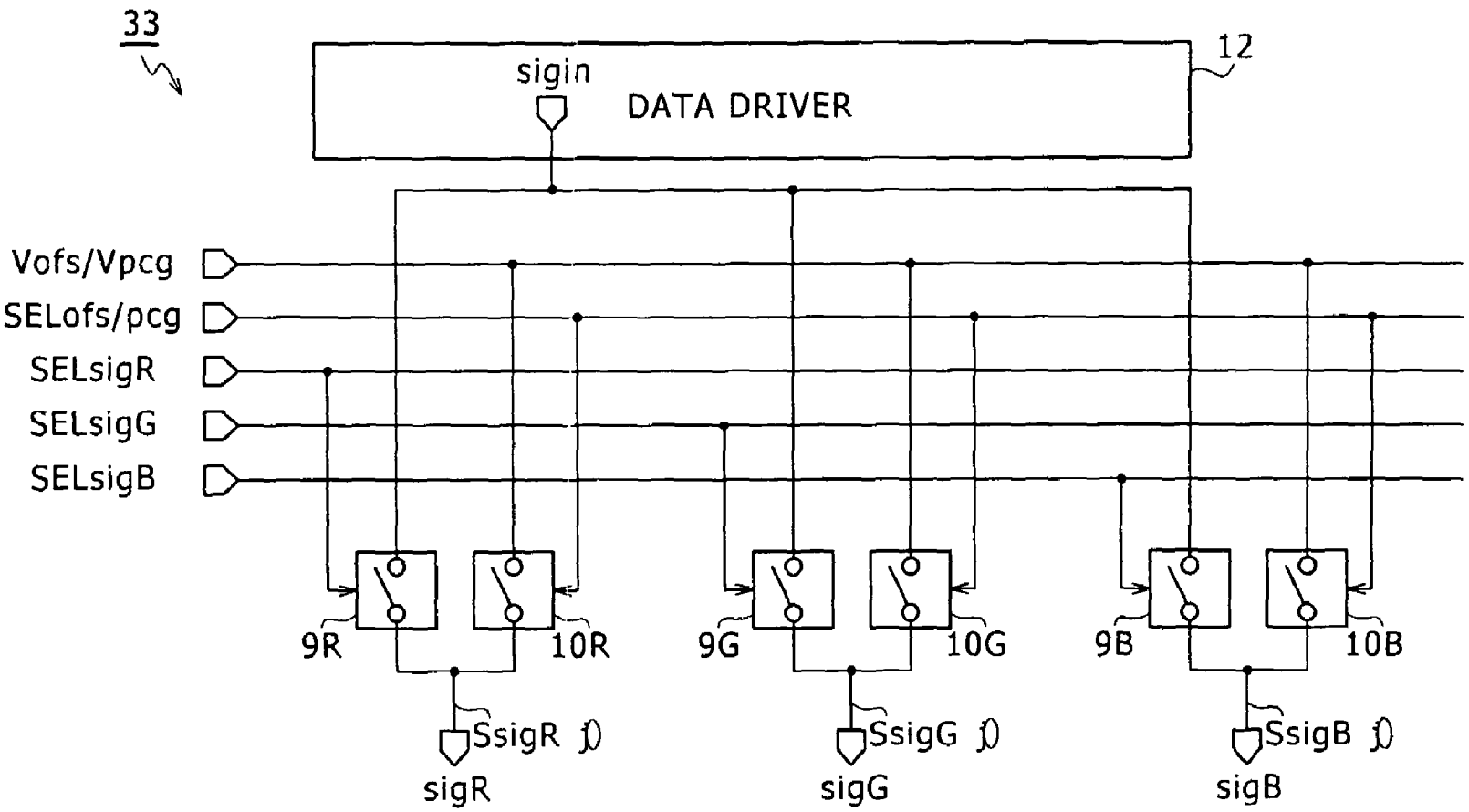
FIG. 7 is a connection diagram showing an output stage of a signal line driving circuit in the image display device of FIG. 5.

FIG. 5 is a diagram showing an image display device 31 according to a second embodiment of the present invention by contrast with FIG. 1. FIGS. 6A to 6H are time charts of assistance in explaining operation of a pixel circuit in the image display device 31 by contrast with FIGS. 2A to 2H. The image display device according to the present embodiment is formed in the same manner as the image display device 21 according to the first embodiment except that a signal line driving circuit 33 shown in FIG. 5 is applied in place of the above-described signal line driving circuit 23.

The signal line driving circuit 33 time-division-multiplexes a fixed voltage Vofs and a precharge voltage Vpcg, and then inputs the result to a switch circuit 10. The switch circuit 10 is subjected to on-off control by an operation signal SELofs/pcg of a control signal SELofs for controlling the output of the fixed voltage Vofs and a control signal SELpcg for controlling the output of the precharge voltage Vpcg. In the present embodiment, an output signal of an OR circuit is used as the operation signal SELofs/pcg. Therefore the control signal SELofs/pcg has a signal level raised for a period when the control signal SELofs is raised and for a period when the control signal SELpcg is raised. In the present embodiment, the two periods are set so as to be continuous with each other. Except for these different configurations, the signal line driving circuit 33 is formed in the same manner as the signal line driving circuit 23 in FIG. 1 (FIGS. 6A to 6H).

Figures 8A, 8B, 8C, 8D, 8E, 8F, 8G, 8H, 8I:
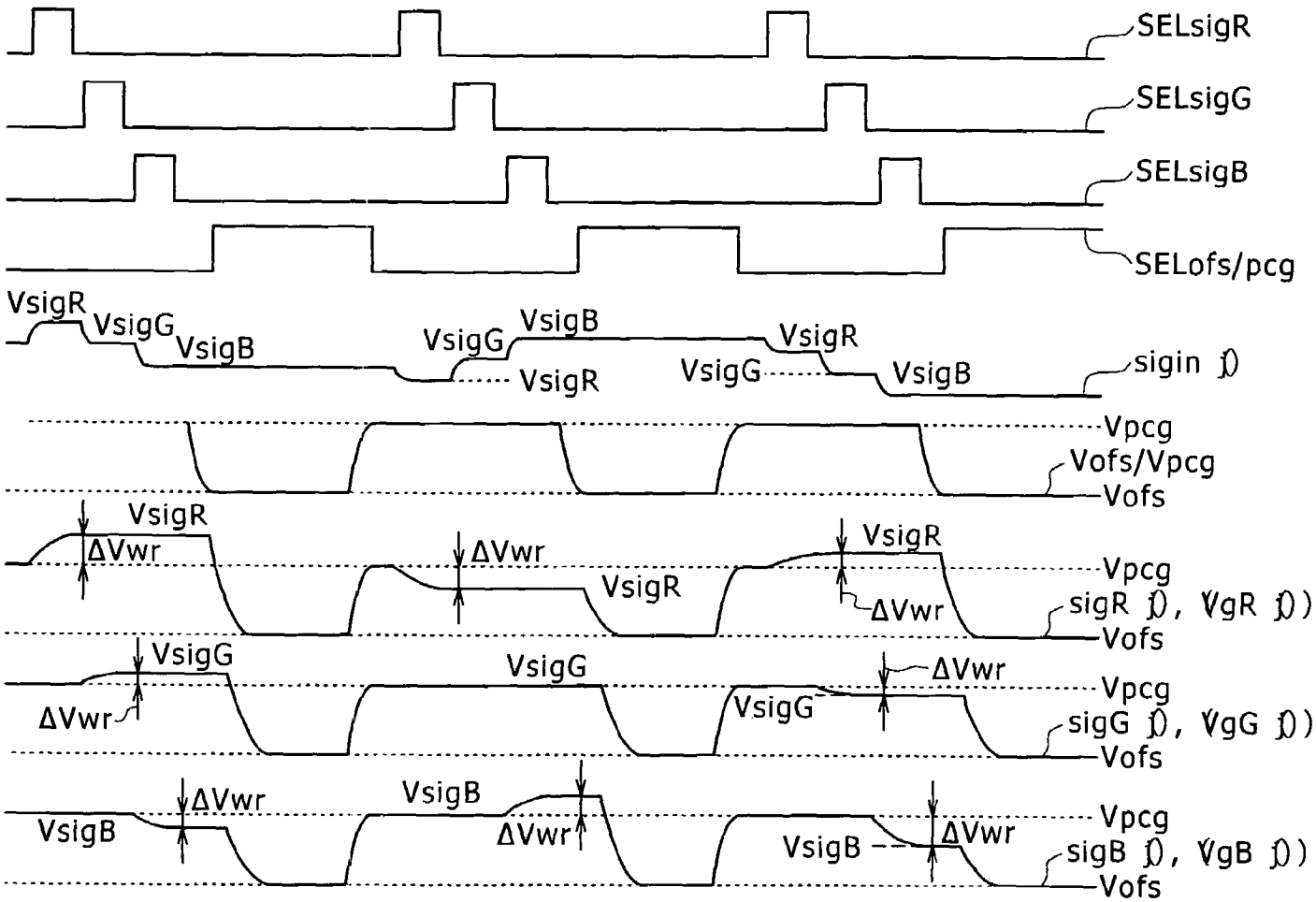
FIGS. 8A to 8I are time charts of assistance in explaining the operation of the signal line driving circuit of FIG. 7.

Specifically, as shown in FIG. 7 and FIGS. 8A to 8I, the signal line driving circuit 33 inputs the time-division-multiplexed signal Vofs/Vpcg of the fixed voltage Vofs and the precharge voltage Vpcg in place of the fixed voltage Vofs to switch circuits 10R, 10G, and 10B (FIG. 8F). In addition, the common control signal SELofs/pcg is input to the switch circuits 10R, 10G, and 10B (FIG. 8D).

Thereby, in the pixel circuits 5R, 5G, and 5B of the image display device 31, a voltage across a storage capacitor Cs is simultaneously set to the threshold voltage of a driving transistor Tr3, and the potential of signal lines sigR, sigG, and sigB is simultaneously set to the precharge voltage Vpcg. Thereafter a gradation setting voltage is sequentially set in each pixel circuit.

According to the present embodiment, the fixed voltage for threshold value correction and the precharge voltage are time-division-multiplexed, input to the switch circuits, and processed. Thereby, the configuration of an output stage of the signal line driving circuit is further simplified, and similar effects to those of the foregoing embodiment can be obtained.

Third Embodiment

Figure 9:
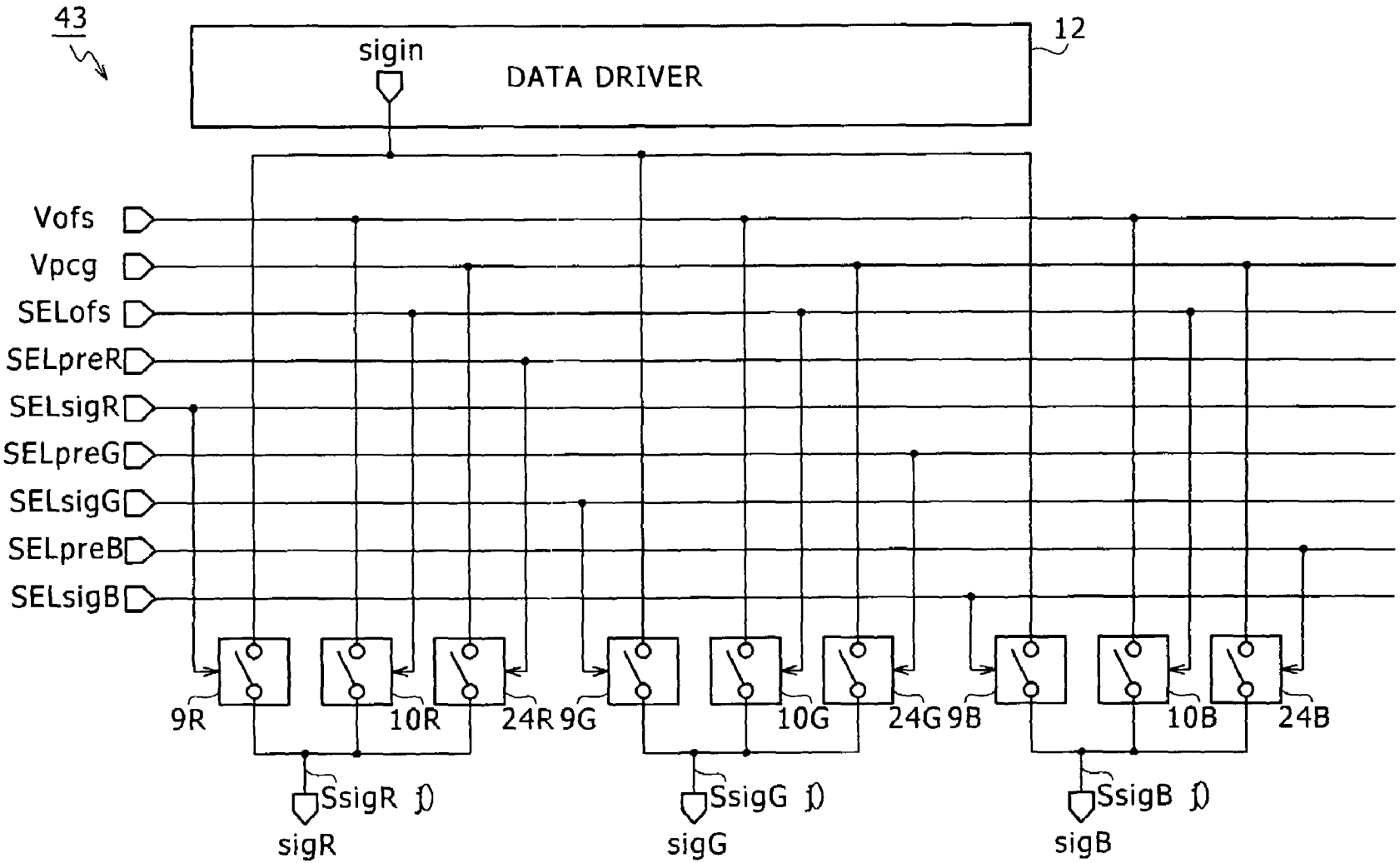
FIG. 9 is a connection diagram showing an output stage of a signal line driving circuit applied to an image display device according to a third embodiment of the present invention.

FIG. 9 is a diagram showing a signal line driving circuit applied to an image display device according to a third embodiment of the present invention by contrast with FIG. 3. The image display device according to the present embodiment is formed in the same manner as the image display device 21 according to the foregoing first embodiment except that the image display device according to the present embodiment has a different configuration with respect to this signal line driving circuit 43.

The signal line driving circuit 43 sets a gradation setting voltage Vsig in a plurality of signal lines sig on a time division basis. The image display device according to the present embodiment also performs a process of raising the potential of the signal lines sig to a precharge voltage Vpcg in the plurality of signal lines sig on a time division basis in such a manner as to correspond to the time-divided setting of the gradation setting voltage Vsig. The signal line driving circuit 43 is formed in the same manner as the signal line driving circuit 23 according to the first embodiment except that the signal line driving circuit 43 has a different configuration with respect to the setting of the precharge voltage Vpcg.

Specifically, the signal line driving circuit 43 supplies respective control signals SELpcgR, SELpcgG, and SELpcgR to switch circuits 24 (24R, 24G, and 24B) for the signal lines sigR, sigG, and sigB of pixel circuits 5R, 5G, and 5B for red, green, and blue which circuits are driven by time division so as to be able to control the switch circuits 24 (24R, 24G, and 24B) individually.

Figures 10A, 10B, 10C, 10D, 10E, 10F, 10G, 10H, 10I, 10J, 10K:
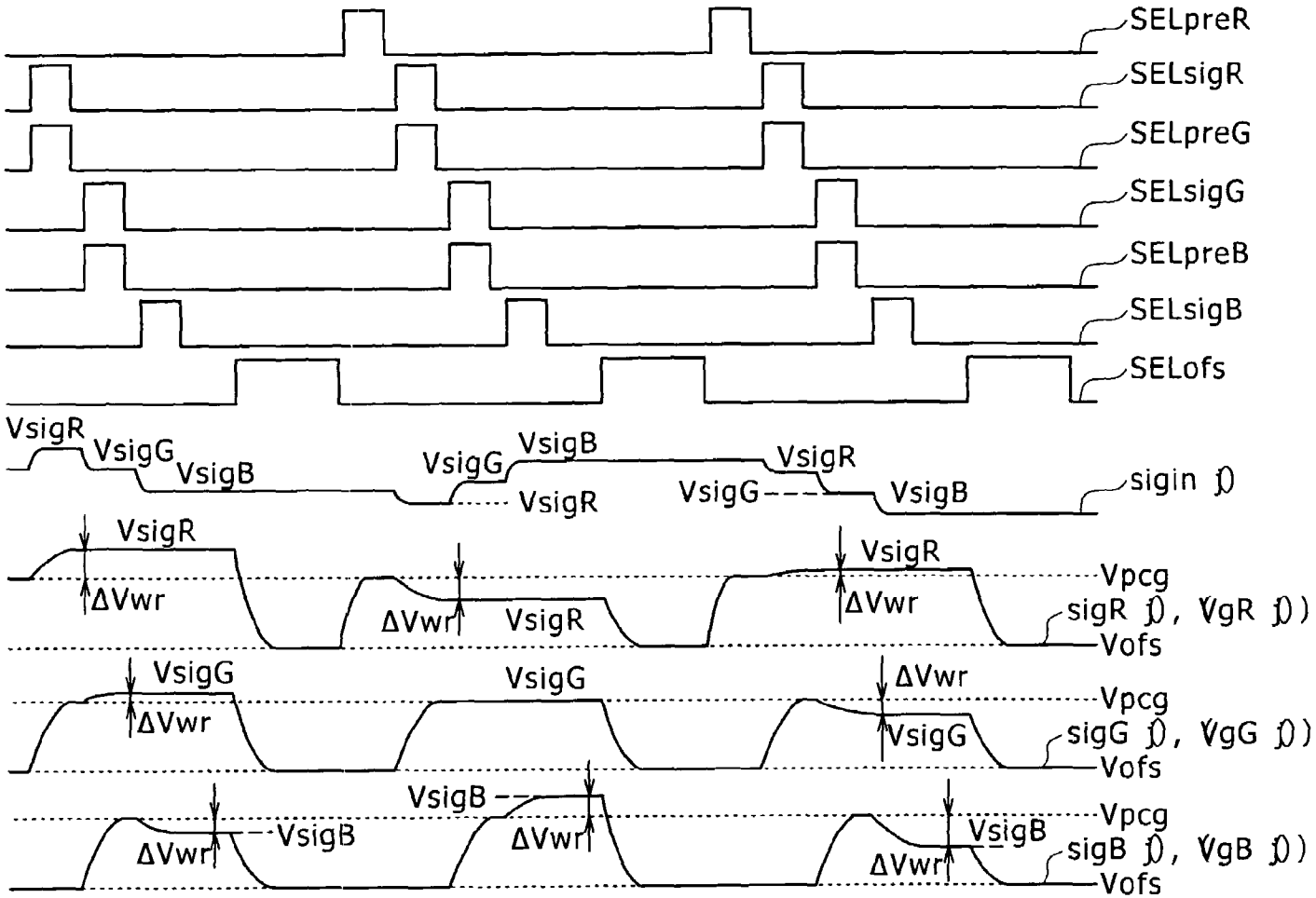
FIGS. 10A to 10K are time charts of assistance in explaining the operation of the signal line driving circuit of FIG. 9.

In this case, as shown in FIGS. 10A to 10K, the signal line driving circuit 43 makes switch circuits 10R, 10G, and 10B simultaneously perform an on operation at a predetermined point in time by a control signal SELofs (FIG. 4G). The signal line driving circuit 43 thereby sets the potential of the signal lines sigR, sigG, and sigB connected to the pixel circuits 5R, 5G, and 5B to a fixed voltage Vofs for threshold value correction (FIGS. 10I to 10K). By the setting of the fixed voltage Vofs, the pixel circuits 5R, 5G, and 5B set a potential difference across a storage capacitor Cs to the threshold voltage Vth of a driving transistor Tr3.

Next, the signal line driving circuit 43 temporarily raises the control signal SELpcgR for the red pixel circuit 5R to make the switch circuit 24R temporarily perform an on operation (FIG. 10A). The signal line driving circuit 43 thereby sets the potential of the signal line sigR connected to the red pixel circuit 5R to a precharge voltage Vpcg (FIG. 10I).

Next, the signal line driving circuit 43 temporarily raises a control signal SELsigR for the red pixel circuit 5R to make a switch circuit 9R temporarily perform an on operation (FIG. 10B). The signal line driving circuit 43 thereby sets the potential of the signal line sigR connected to the red pixel circuit 5R to the gradation setting voltage Vsig (FIG. 10I). The pixel circuit 5R makes a writing transistor Tr1 perform an on operation so as to correspond to the setting of the gradation setting voltage Vsig. The image display device 21 thereby sets the gate voltage Vg of the driving transistor Tr3 to the gradation setting voltage Vsig for the red pixel circuit 5R. The red pixel circuit 5R starts an emission period and makes an organic EL element emit light according to the setting of the gradation setting voltage Vsig.

At the same time as the setting of the signal line sig for red to the gradation setting voltage Vsig, the signal line driving circuit 43 temporarily raises the control signal SELpcgG for the next green pixel circuit 5G to make the switch circuit 24G temporarily perform an on operation (FIG. 10C). The signal line driving circuit 43 thereby sets the potential of the signal line sigG connected to the green pixel circuit 5G to the precharge voltage Vpcg (FIG. 10J).

Next, the signal line driving circuit 43 temporarily raises a control signal SELsigG for the green pixel circuit 5G to make a switch circuit 9G temporarily perform an on operation (FIG. 10D). The signal line driving circuit 43 thereby sets the potential of the signal line sigG connected to the pixel circuit 5G to the gradation setting voltage Vsig (FIG. 10J). The pixel circuit 5G makes a writing transistor Tr1 perform an on operation so as to correspond to the setting of the gradation setting voltage Vsig. The image display device 21 thereby sets the gate voltage Vg of the driving transistor Tr3 to the gradation setting voltage Vsig for the green pixel circuit 5G. The green pixel circuit 5G starts an emission period and makes an organic EL element emit light according to the setting of the gradation setting voltage Vsig.

At the same time as the setting of the signal line sig for green to the gradation setting voltage Vsig, the signal line driving circuit 43 temporarily raises the control signal SELpcgB for the next blue pixel circuit 5B to make the switch circuit 24B temporarily perform an on operation (FIG. 10E). The signal line driving circuit 43 thereby sets the potential of the signal line sigB connected to the blue pixel circuit 5B to the precharge voltage Vpcg (FIG. 10K).

Next, the signal line driving circuit 43 temporarily raises a control signal SELsigB for the blue pixel circuit 5B to make a switch circuit 9B temporarily perform an on operation (FIG. 10F). The signal line driving circuit 43 thereby sets the potential of the signal line sigB connected to the pixel circuit 5B to the gradation setting voltage Vsig (FIG. 10K). The pixel circuit 5B makes a writing transistor Tr1 perform an on operation so as to correspond to the setting of the gradation setting voltage Vsig. The image display device 21 thereby sets the gate voltage Vg of the driving transistor Tr3 to the gradation setting voltage Vsig for the blue pixel circuit 5B. The blue pixel circuit 5B starts an emission period and makes an organic EL element emit light according to the setting of the gradation setting voltage Vsig.

Thus, in the present embodiment, while the potential of the signal lines sig is sequentially set to the precharge voltage Vpcg, the gate voltage of the driving transistor Tr3 is set to the gradation setting voltage Vsig sequentially from a pixel circuit for which the setting of the precharge voltage Vpcg is completed.

Thus, the present embodiment can reduce the capacitance of a load formed by the signal lines sig to ⅓ of that of the configurations of the first and second embodiments, and sequentially set the precharge voltage Vpcg.

Thus, the present embodiment can increase a time assignable to the setting of the gradation setting voltage as compared with the configurations of the first and second embodiments, and consequently set the gradation of each pixel circuit with even higher precision.

According to the present embodiment, the gradation of each pixel circuit can be set with even higher precision by raising predetermined potential on a time division basis so as to correspond to the time-division driving of signal lines.

Fourth Embodiment

Figure 11:
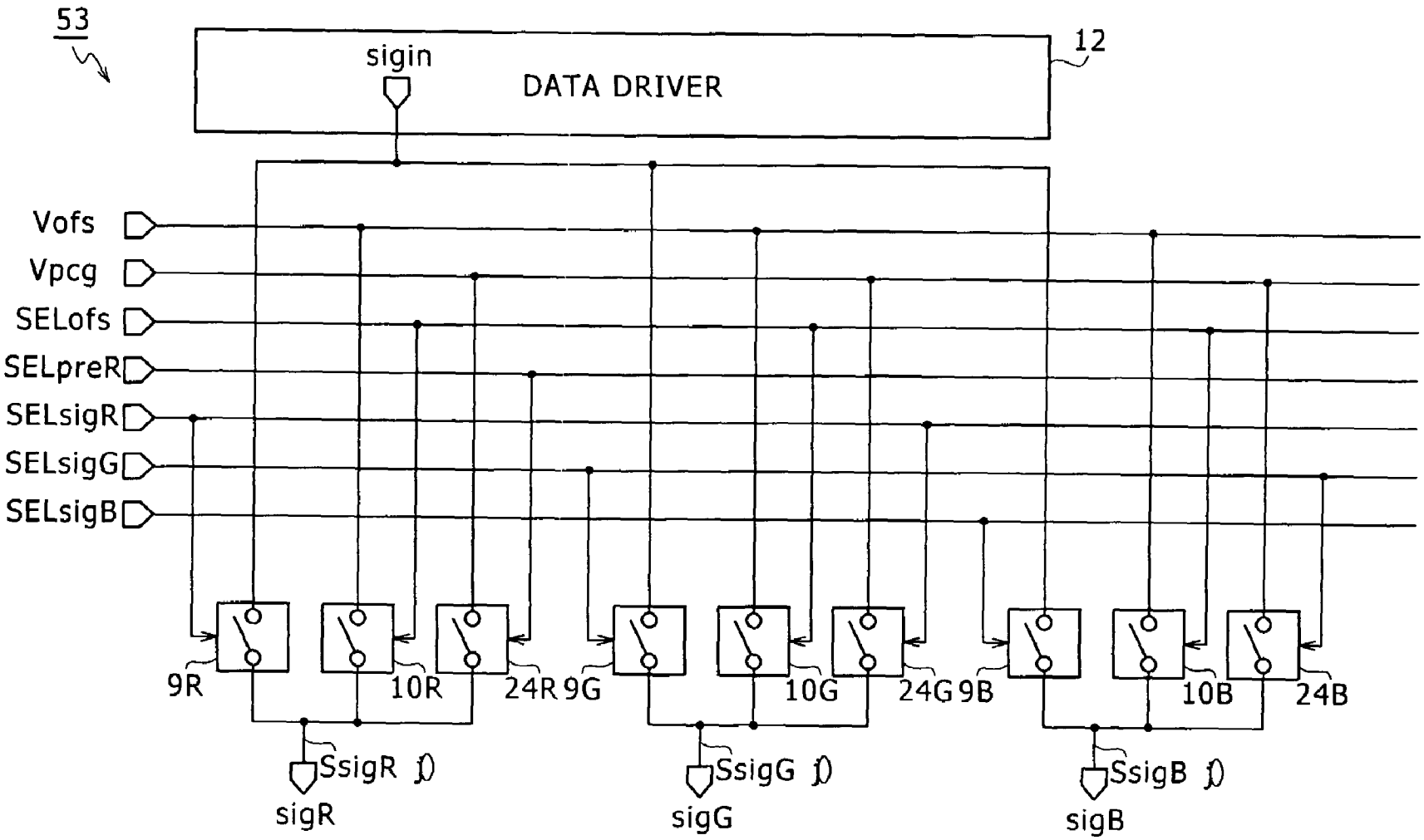
FIG. 11 is a connection diagram showing an output stage of a signal line driving circuit applied to an image display device according to a fourth embodiment of the present invention.
Figures 12A, 12B, 12C, 12D, 12E, 12F, 12G, 12H, 12I:
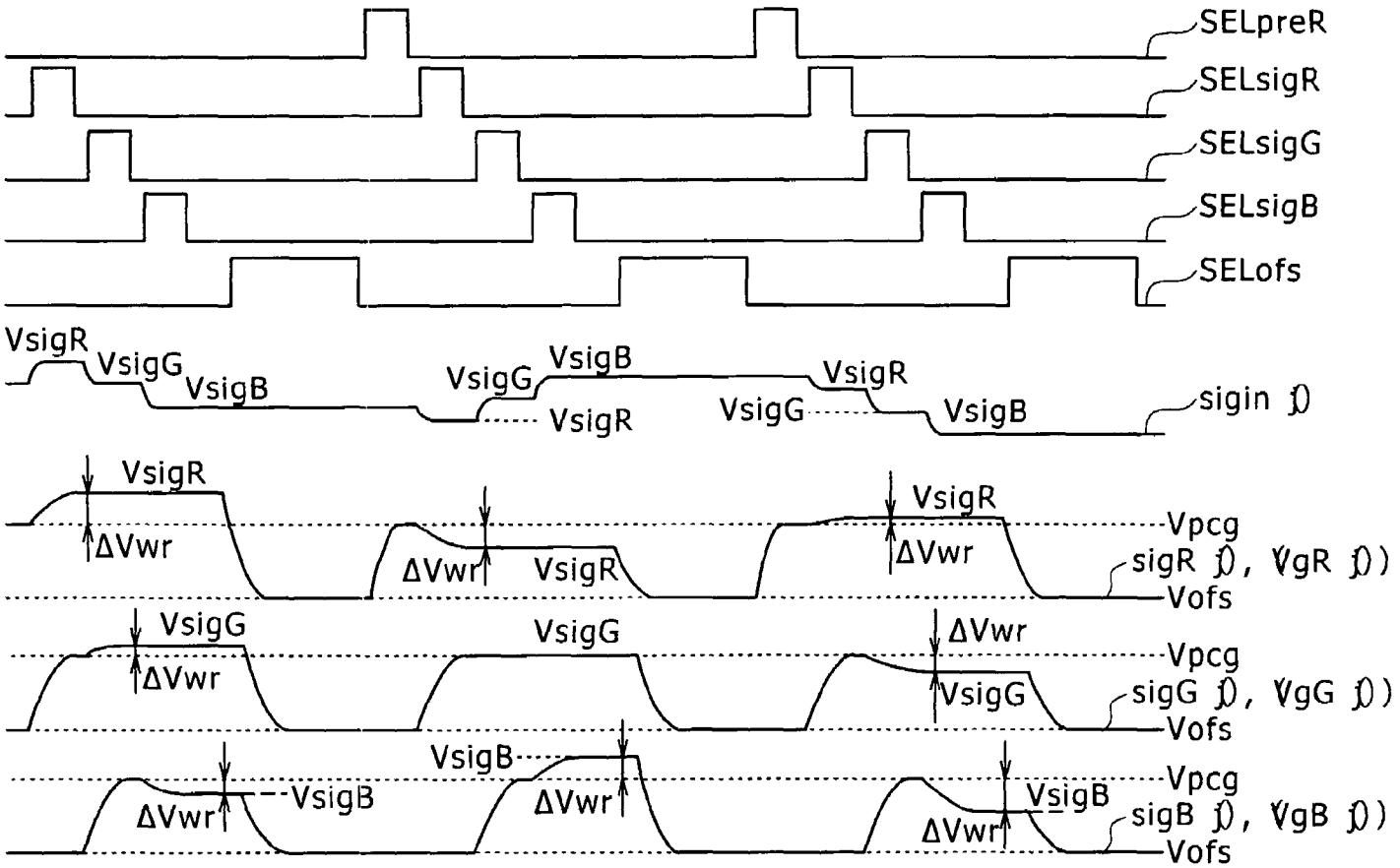
FIGS. 12A to 12I are time charts of assistance in explaining the operation of the signal line driving circuit of FIG. 11.

FIG. 11 is a connection diagram showing a configuration of a signal line driving circuit applied to an image display device according to a fourth embodiment of the present invention by contrast with FIG. 9. FIGS. 12A to 12I are time charts showing the operation of the signal line driving circuit 53 by contrast with FIGS. 10A to 10K. The image display device according to the present embodiment is formed in the same manner as the image display device according to the third embodiment except that the signal line driving circuit 53 shown in FIG. 11 is applied in place of the above-described signal line driving circuit 43.

The signal line driving circuit 53 in this case performs on-off control on a switch circuit 24 for precharge voltage using a control signal SELsig for performing on-off control on a switch circuit 9 for setting gradation voltage. The signal line driving circuit 53 is formed in the same manner as the signal line driving circuit 43 according to the third embodiment except that the signal line driving circuit 53 has a different configuration for on-off control on the switch circuit 24 for the precharge voltage.

Specifically, using a control signal SELsigR for a switch circuit 9R for outputting a gradation setting voltage VsigR to a signal line sigR for red, the signal line driving circuit 53 performs on-off control on a switch circuit 24G for outputting a precharge voltage Vpcg to a next signal line sigG for green. In addition, using a control signal SELsigG for a switch circuit 9G for outputting a gradation setting voltage VsigG to the signal line sigG for green, the signal line driving circuit 53 performs on-off control on a switch circuit 24B for outputting the precharge voltage Vpcg to a next signal line sigB for blue.

Thus, as with the image display device according to the fourth embodiment, the image display device according to the present embodiment raises signal lines to the precharge voltage Vpcg on a time division basis so as to correspond to the time-division driving of the signal lines. In addition, the gate voltage of a driving transistor Tr3 is set to a gradation setting voltage Vsig sequentially from a pixel circuit for which the setting of the precharge voltage Vpcg is completed.

According to the present embodiment, a control signal for performing on-off control on a switch circuit for setting gradation voltage is used to control a switch circuit for precharge voltage. Thereby, the configuration of the signal line driving circuit is simplified, and the same effects as those of the third embodiment can be obtained.

Fifth Embodiment

Figure 13:
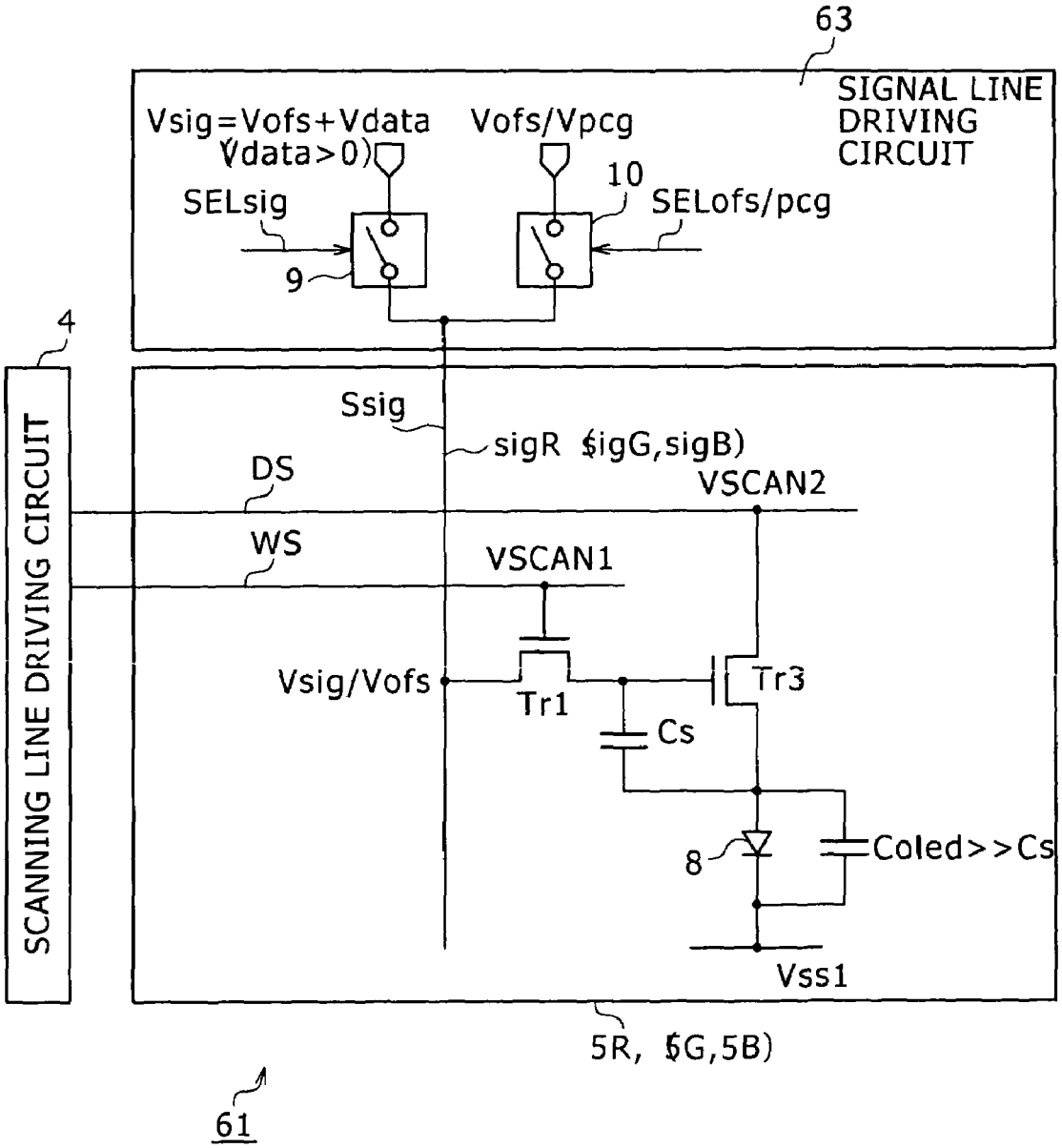
FIG. 13 is a diagram showing an image display device according to a fifth embodiment of the present invention.
Figures 14A, 14B, 14C, 14D, 14E, 14F, 14G, 14H:
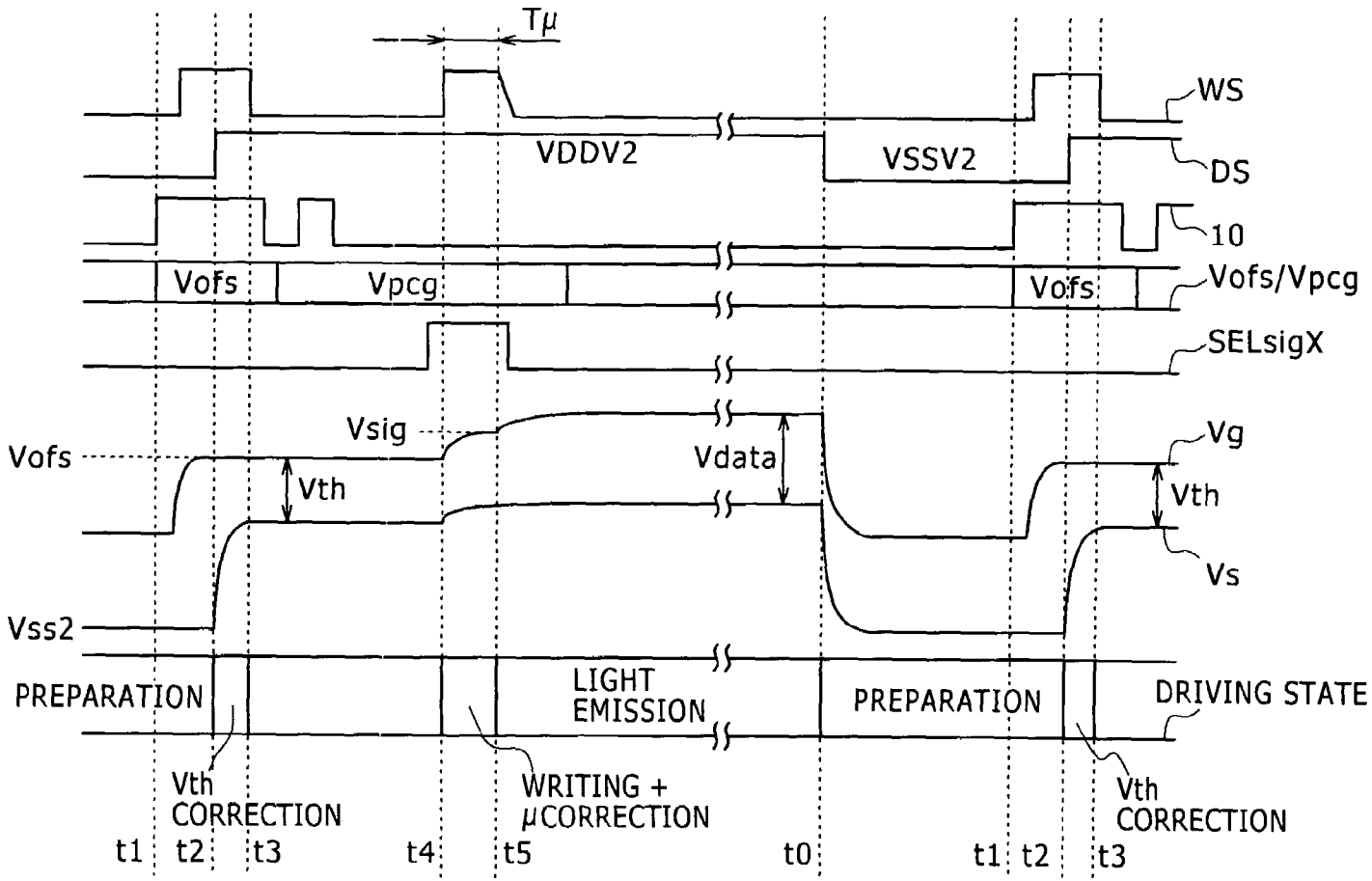
FIGS. 14A to 14H are time charts of assistance in explaining the operation of a pixel circuit in the image display device of FIG. 13.

FIG. 13 is a diagram showing an image display device according to a fifth embodiment of the present invention by contrast with FIG. 5. FIGS. 14A to 14H are time charts of assistance in explaining operation of each pixel circuit in the image display device 61 by contrast with FIGS. 6A to 6H. A signal line driving circuit 63 is applied to the image display device 61 according to the present embodiment in place of the signal line driving circuit 33. The image display device 61 is formed in the same manner as the image display device 31 according to the second embodiment except that the image display device 61 has a different configuration with respect to the signal line driving circuit 63.

In addition, the signal line driving circuit 63 is formed in the same manner as the signal line driving circuit 33 except for different control of a switch circuit 10. The signal line driving circuit 63 time-division-multiplexes a fixed voltage Vofs and a precharge voltage Vpcg, and then inputs the result to the switch circuit 10. The signal line driving circuit 63 performs on-off control on the switch circuit 10 by an operation signal of a control signal SELofs for controlling the output of the fixed voltage Vofs and a control signal SELpcg for controlling the output of the precharge voltage Vpcg (FIGS. 14A to 14H).

Figure 15:
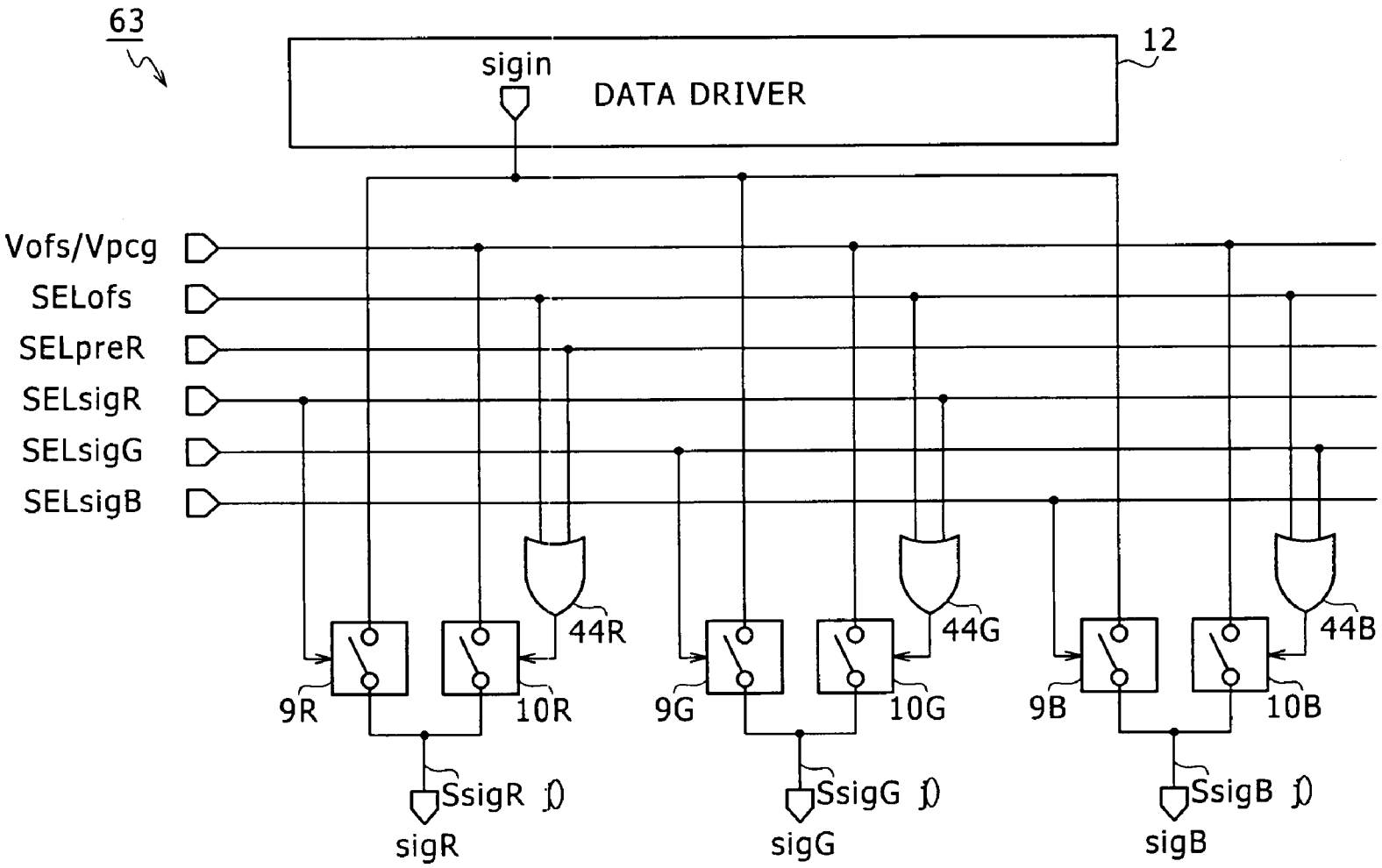
FIG. 15 is a connection diagram showing an output stage of a signal line driving circuit in the image display device of FIG. 13.
Figures 16A, 16B, 16C, 16D, 16E, 16F, 16G, 16H, 16I, 16J:
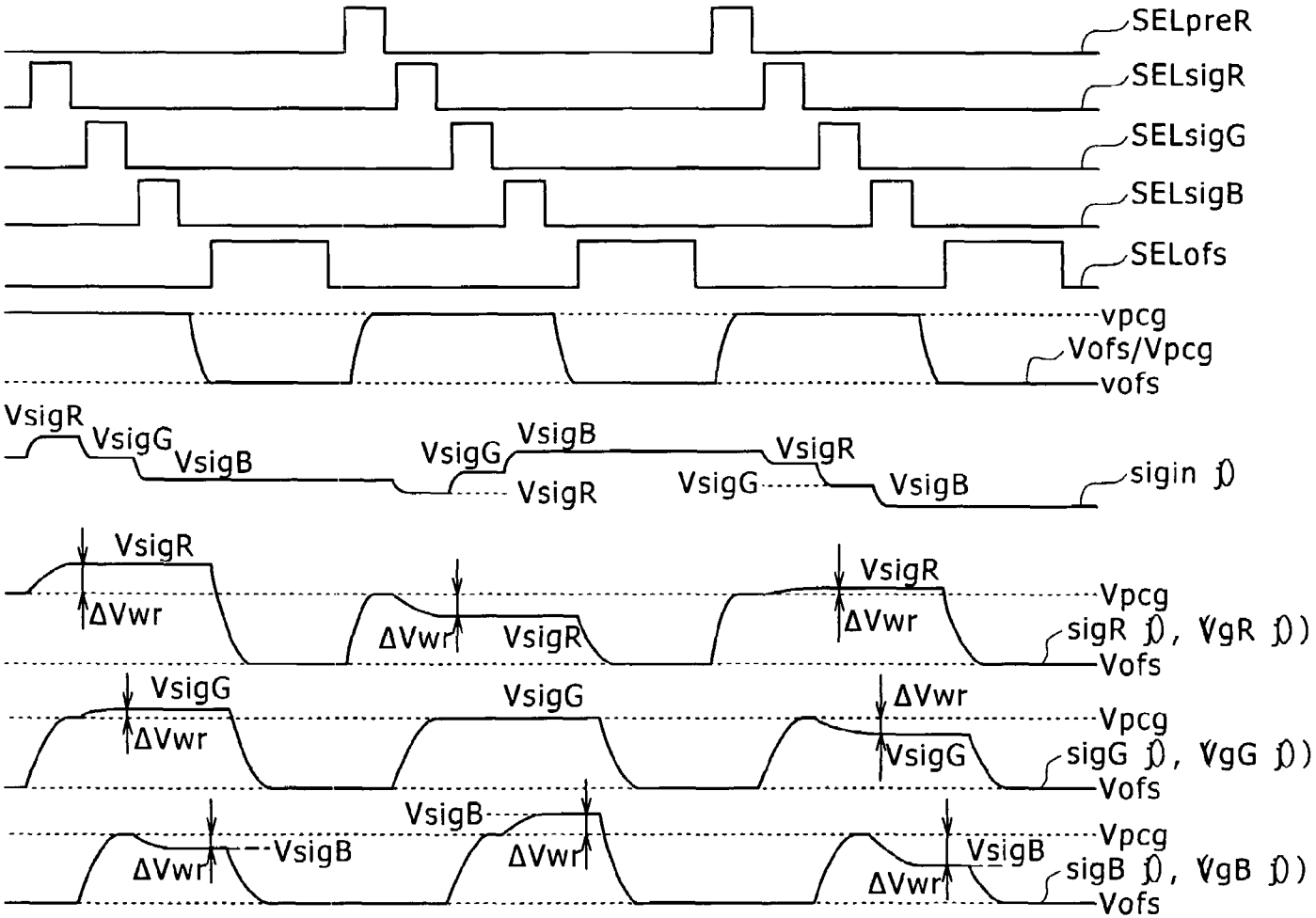
FIGS. 16A to 16J are time charts of assistance in explaining the operation of the signal line driving circuit of FIG. 15.

Specifically, as shown in FIG. 15, the signal line driving circuit 63 has OR circuits 44R, 44G, and 44B for performing on-off control on switch circuits 10R, 10G, and 10B, respectively. The OR circuits 44R, 44G, and 44B are each supplied with the control signal SELofs for controlling the output of the fixed voltage Vofs and the control signal SELpcg for controlling the output of the precharge voltage Vpcg.

As shown in FIGS. 16A to 16J by contrast with FIGS. 12A to 12I, the signal line driving circuit 63 time-division-multiplexes the fixed voltage Vofs and the precharge voltage Vpcg and then inputs the result to the switch circuit 10 (FIG. 16F), and sequentially raises the control signal SELofs and control signals SELpcgR, SELpcgG, and SELpcgB in such a manner as to be interlocked with the output of the fixed voltage Vofs and the precharge voltage Vpcg (FIGS. 16A to 16E).

The signal line driving circuit 63 raises the control signal SELofs and the control signals SELpcgR, SELpcgG, and SELpcgB as in the third embodiment. The image display device 61 thereby processes the driving signal by time division of the fixed voltage Vofs and the precharge voltage Vpcg by the signal line driving circuit in a configuration that raises signal lines to the precharge voltage Vpcg on a time division basis so as to correspond to the time-division driving of the signal lines.

Similar effects to those of the foregoing embodiments can be obtained also when a fixed voltage for threshold voltage correction and a precharge voltage are time-division-multiplexed and processed by a switch circuit, and signal lines are sequentially set to the precharge voltage, as in the present embodiment.

Sixth Embodiment

Figure 17:
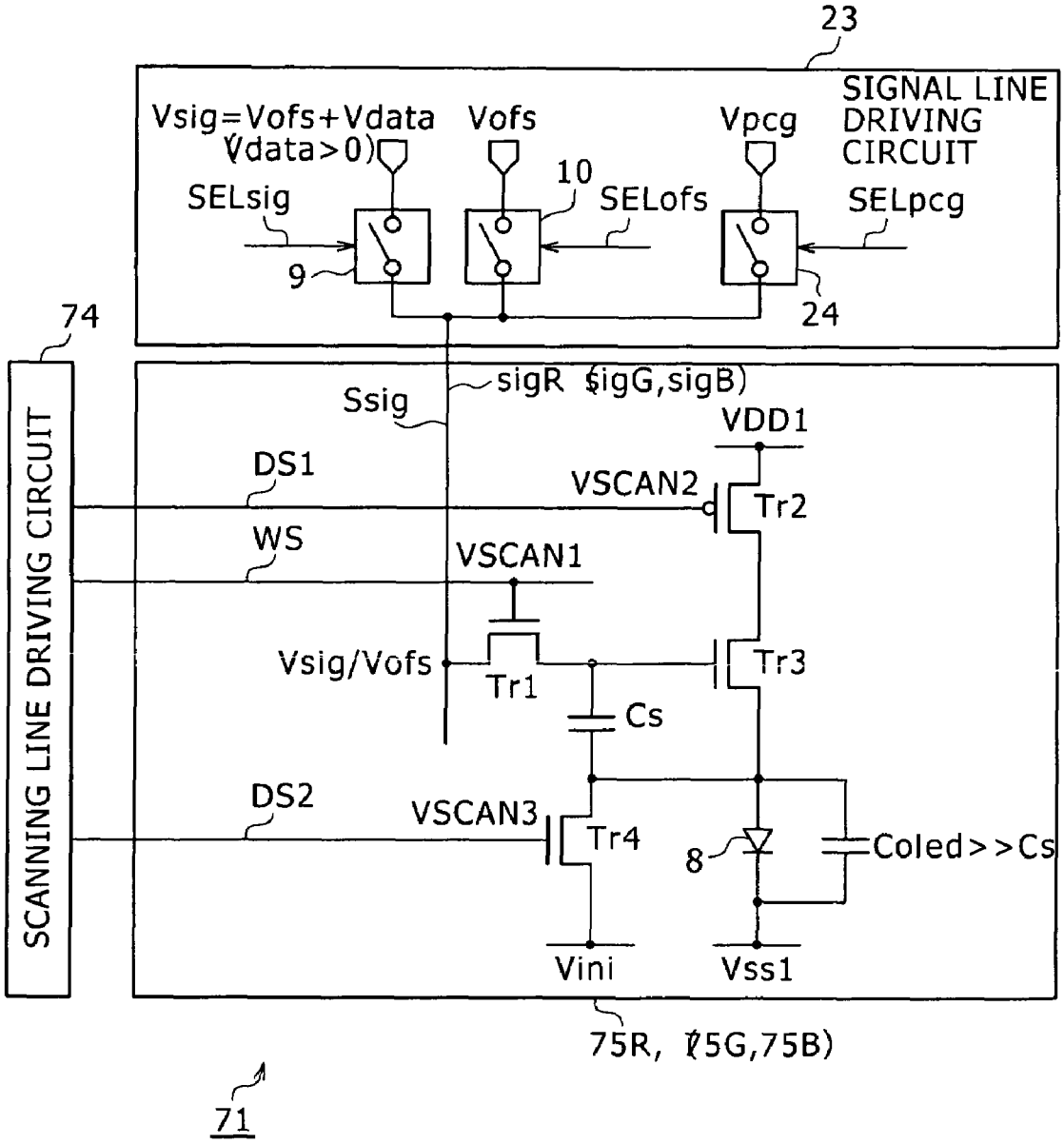
FIG. 17 is a diagram showing an image display device according to a sixth embodiment of the present invention.

FIG. 17 is a diagram showing an image display device according to a sixth embodiment of the present invention by contrast with FIG. 1. FIGS. 18A to 18I are time charts of assistance in explaining operation of pixel circuits 75R, 75G, and 75B applied to the image display device by contrast with FIGS. 2A to 2H. The pixel circuits 75R, 75G, and 75B shown in FIG. 17 are applied to the image display device 71 according to the present embodiment in place of the above-described pixel circuits 5R, 5G, and 5B. In addition, a scanning line driving circuit 74 is applied to the image display device 71 in place of the scanning line driving circuit 4 so as to correspond to the configuration of the pixel circuits 75R, 75G, and 75B. The image display device 71 according to the present embodiment is formed in the same manner as the image display device according to each of the foregoing embodiments except that the image display device 71 has a different configuration with respect to the pixel circuits 75R, 75G, and 75B. Thus, while FIG. 17 and FIGS. 18A to 18I represent a case of using the signal line driving circuit 23 described above in relation to the image display device 31 according to the first embodiment, various signal line driving circuits used in the image display devices according to the foregoing embodiments can be widely applied as the signal line driving circuit.

In the image display device 71, the pixel circuit 75R (75G and 75B) has a transistor Tr2 for power supply control between the drain of a driving transistor Tr3 and a power supply VDD1. The pixel circuit 75R (75G and 75B) controls power to the driving transistor Tr3 by on-off control on the transistor Tr2.

In addition, the pixel circuit 75R (75G and 75B) further includes a transistor Tr4 provided to the source of the driving transistor Tr3, the transistor Tr4 setting the source voltage Vs of the driving transistor Tr3 to a predetermined fixed voltage Vini. At a time of setting a voltage across a storage capacitor Cs to the threshold voltage Vth of the driving transistor Tr3, the pixel circuit 75R (75G and 75B) sets the voltage across the storage capacitor Cs to more than the threshold voltage Vth of the driving transistor Tr3 by on-off control on the transistor Tr4.

Figures 18A, 18B, 18C, 18D, 18E, 18F, 18G, 18H, 18I:
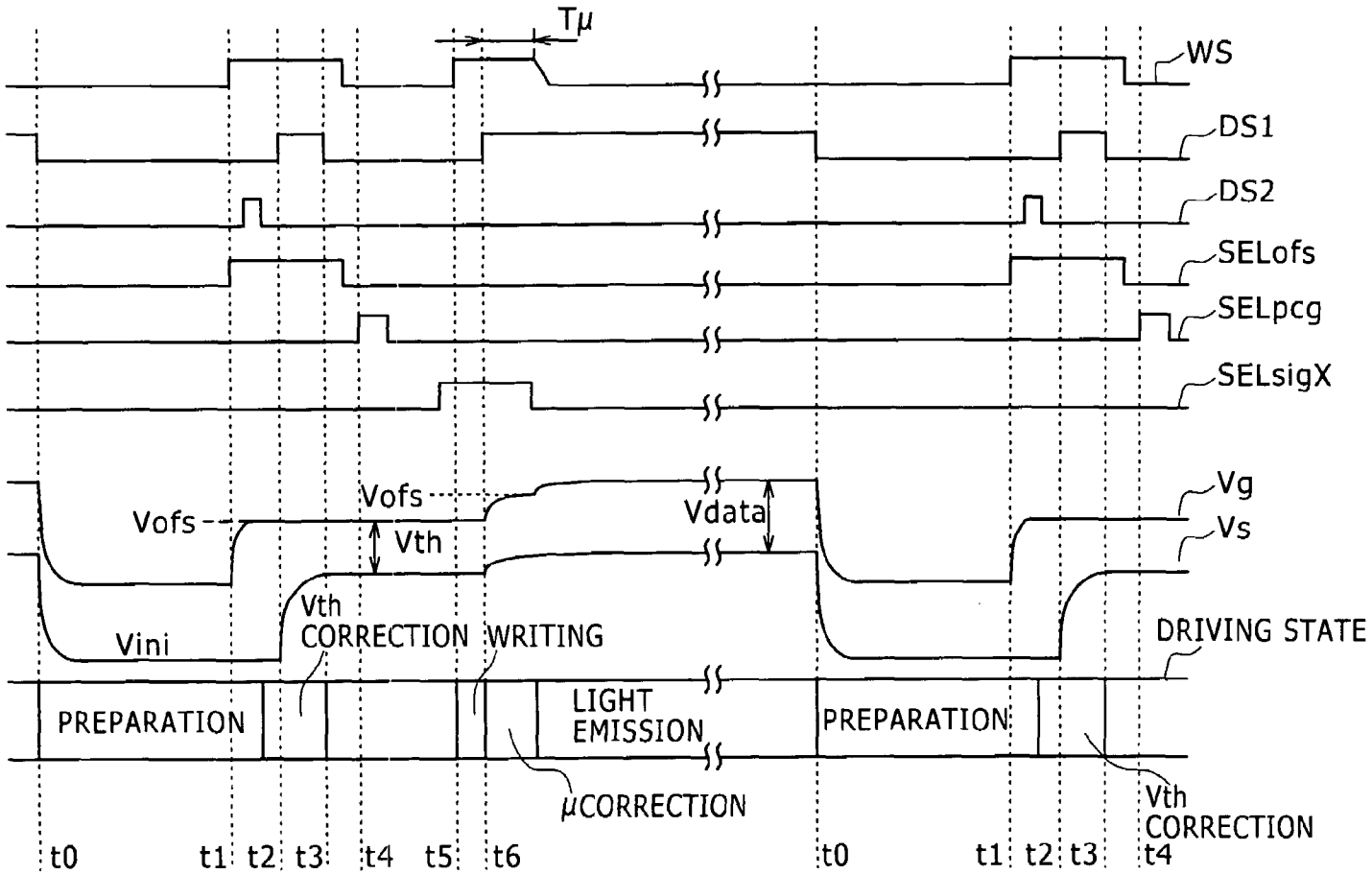
FIGS. 18A to 18I are time charts of assistance in explaining the operation of a pixel circuit in the image display device of FIG. 17.

Specifically, when an emission period ends at time point t0 (FIG. 18I), the pixel circuit 75R (75G and 75B) sets the transistor Tr2 in an off state (FIG. 18B). Thereby, in the pixel circuit 75R (75G and 75B), a charge accumulated in the storage capacitor Cs is gradually discharged via an organic EL element 8. As a result, in the pixel circuit 75R (75G and 75B), the source voltage Vs of the driving transistor Tr3 is gradually lowered. When a voltage across the organic EL element 8 becomes the threshold voltage Vtholed of the organic EL element 8, the discharge via the organic EL element 8 is stopped, and the lowering of the source voltage Vs is stopped (FIG. 18H). Incidentally, the gate voltage Vg of the driving transistor Tr3 is lowered so as to follow the lowering of the source voltage Vs (FIG. 18G). Thereby, in the pixel circuit 75R (75G and 75B), the organic EL element 8 stops emitting light.

Next, in the pixel circuit 75R (75G and 75B), a writing signal WS is raised at time point t1 to set a writing transistor Tr1 in an on state. Thereby, in the pixel circuit 75R (75G and 75B), the gate voltage Vg of the driving transistor Tr3 is set to a fixed voltage Vofs. Next, in the pixel circuit 75R (75G and 75B), the transistor Tr4 is temporarily set in an on state by a driving signal DS2. Thereby, in the pixel circuit 75R (75G and 75B), the source voltage Vs of the driving transistor Tr3 is set to the voltage Vini. Thereby, in the pixel circuit 75R (75G and 75B), the voltage Vgs across the storage capacitor Cs is set to a voltage (Vofs−Vini), which is more than the threshold voltage Vth of the driving transistor Tr3.

In the pixel circuit 75R (75G and 75B), the transistor Tr2 is set in an on state by a driving signal DS1 at next time point t2 to start supplying power VDD1 to the driving transistor Tr3. Thereby, in the pixel circuit 75R (75G and 75B), the voltage Vgs across the storage capacitor Cs is set to the threshold voltage Vth of the driving transistor Tr3.

In the pixel circuit 75R (75G and 75B), the transistor Tr2 is set in an off state by the driving signal DS1 at next time point t3 to stop supplying the power VDD1 to the driving transistor Tr3. Thereafter, in the pixel circuit 75R (75G and 75B), the supply of the fixed voltage Vofs to the signal line sig is stopped, and the writing transistor Tr1 is set in an off state by the writing signal WS.

In the pixel circuit 75R (75G and 75B), at next time point t4, a switch circuit 24 is set in an on state to set the potential of the signal line sig to a precharge voltage Vpcg. The setting of the precharge voltage Vpcg in the pixel circuit 75R (75G and 75B) is made simultaneously in a plurality of pixel circuits whose signal lines are driven on a time division basis, or made sequentially on a time division basis, depending on which of the signal line driving circuits according to the foregoing embodiments is applied.

In the pixel circuit 75R (75G and 75B), the potential of the signal line sig is thereafter set to a gradation setting voltage Vsig by on-off control on the switch circuits 24 and 9, and then the writing transistor Tr1 is set in an on state at time point t5 to set the gate voltage Vg of the driving transistor Tr3 to the gradation setting voltage Vsig. In addition, the supply of the power VDD1 to the driving transistor Tr3 is started at time point t6.

Similar effects to those of each of the foregoing embodiments can be obtained also when power to a driving transistor provided in each pixel circuit and the source voltage of the driving transistor are controlled by individual transistors as in the present embodiment.

Seventh Embodiment

Figure 19:
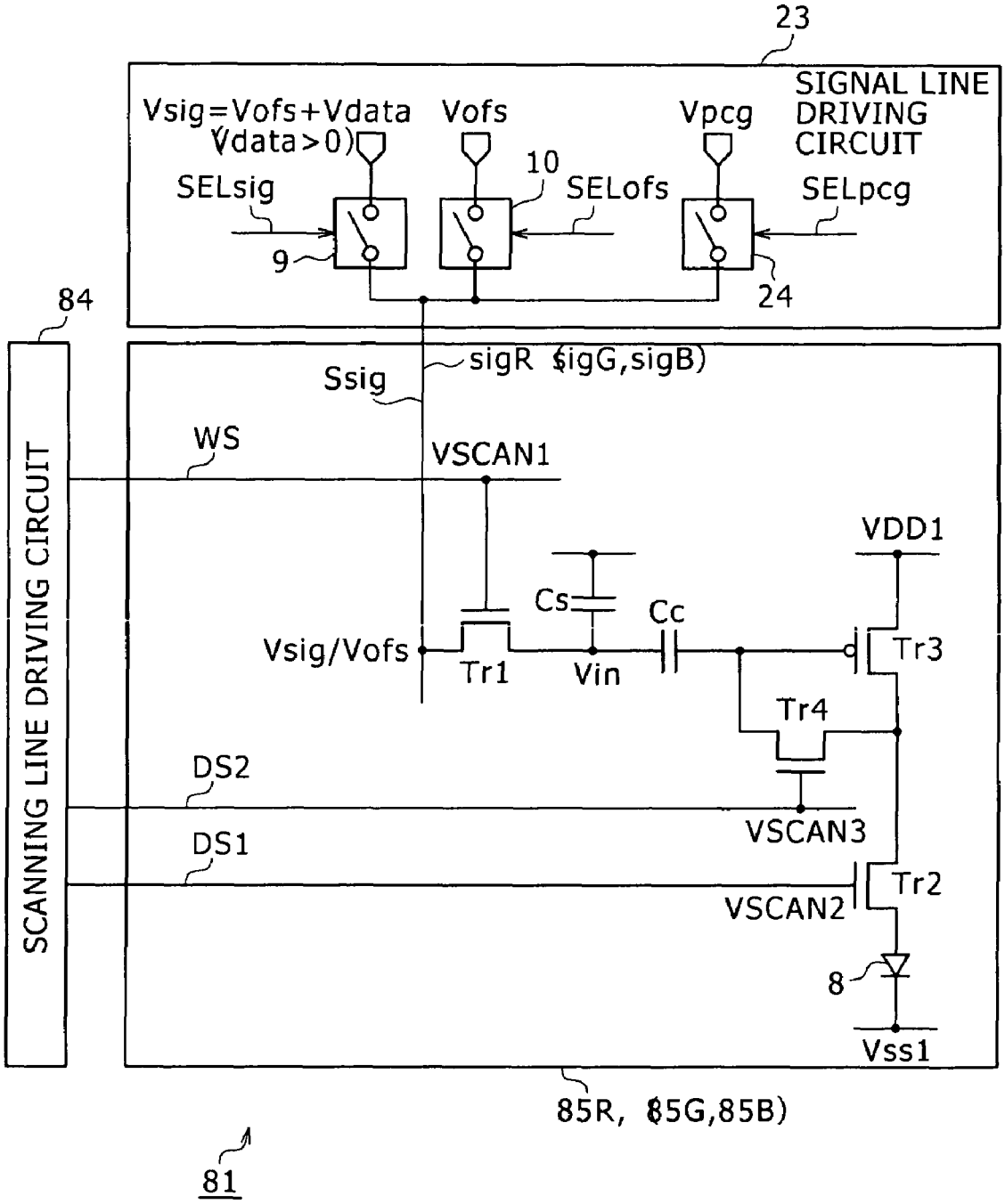
FIG. 19 is a diagram showing an image display device according to a seventh embodiment of the present invention.
Figures 20A, 20B, 20C, 20D, 20E, 20F, 20G, 20H, 20I:
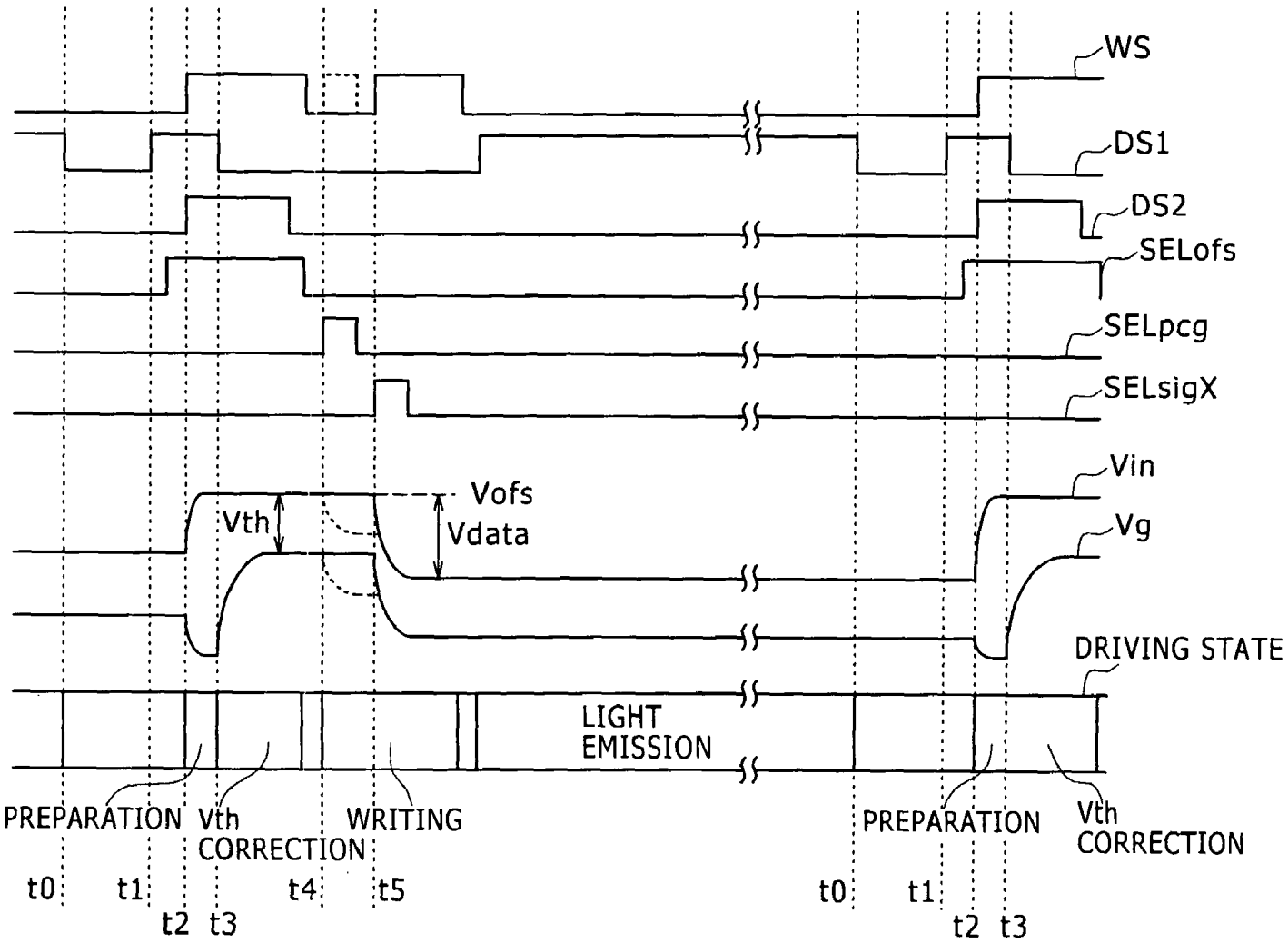
FIGS. 20A to 20I are time charts of assistance in explaining the operation of a pixel circuit in the image display device of FIG. 19.
Figures 21A, 21B, 21C, 21D, 21E, 21F, 21G, 21H, 21I:
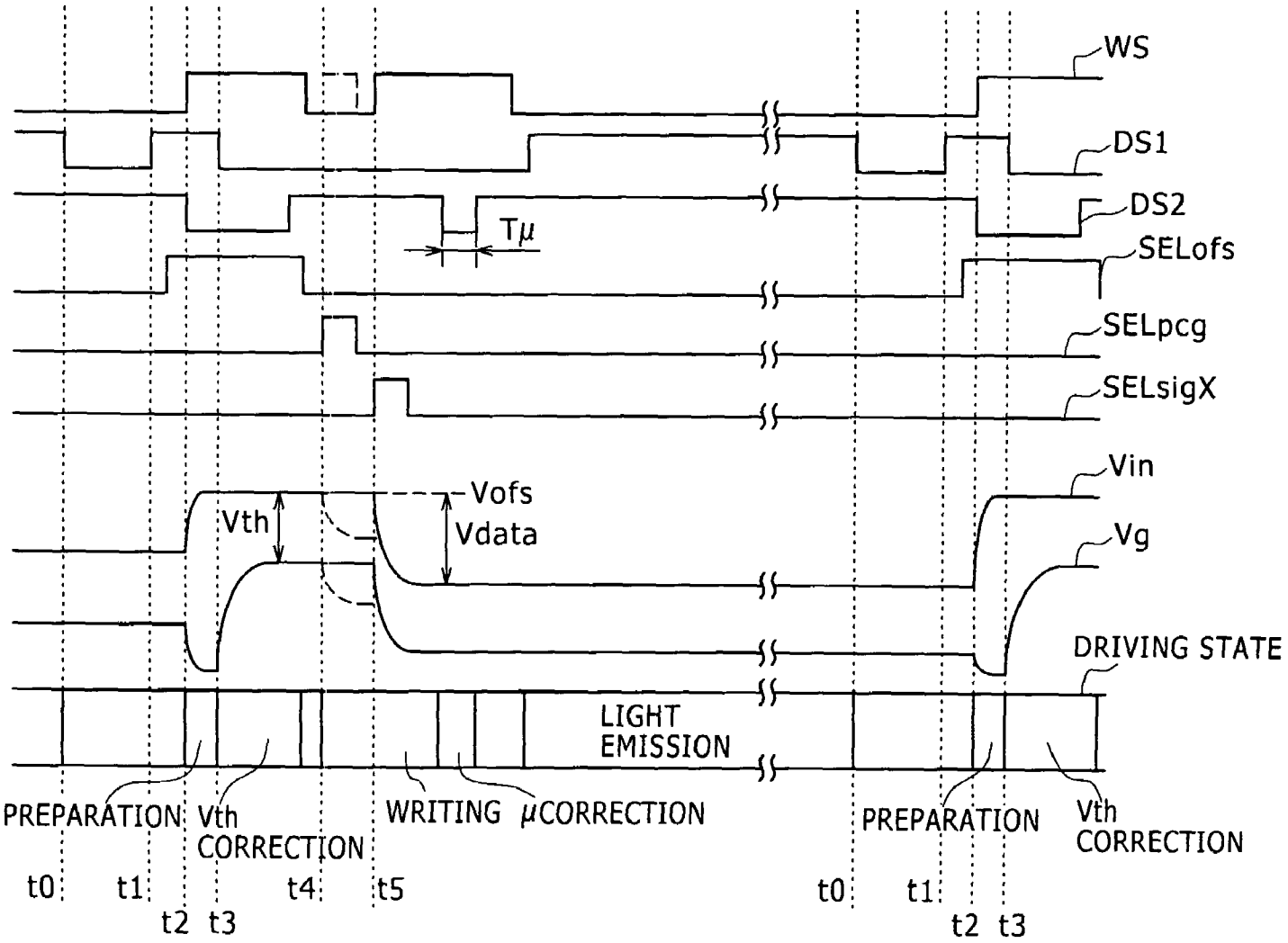
FIGS. 21A to 21I are time charts of a case where variation in mobility is corrected in the image display device of FIG. 19.

FIG. 19 is a diagram showing a pixel circuit 85R, 85G, or 85B applied to an image display device according to a seventh embodiment of the present invention by contrast with FIG. 17. FIGS. 20A to 20I are time charts of assistance in explaining operation of the pixel circuits 85R, 85G, and 85B applied to the image display device by contrast with FIGS. 18A to 18I. The pixel circuits 85R, 85G, and 85B shown in FIG. 19 are applied to the image display device 81 according to the present embodiment in place of the above-described pixel circuits 75R, 75G, and 75B. In addition, a scanning line driving circuit 84 is applied to the image display device 81 in place of the scanning line driving circuit 74 so as to correspond to the configuration of the pixel circuits 85R, 85G, and 85B. The image display device 81 according to the present embodiment is formed in the same manner as the image display device 71 according to the foregoing sixth embodiment except that the image display device 81 has a different configuration with respect to the pixel circuits 85R, 85G, and 85B.

In the pixel circuit 85R (85G and 85B), a driving transistor Tr3 is formed by a P-channel type transistor. In the pixel circuit 85R (85G and 85B), a transistor Tr2 performing on-off operation according to a driving signal DS1 is provided between the drain of the driving transistor Tr3 and the anode of an organic EL element 8. The pixel circuit 85R (85G and 85B) thereby controls the emission and non-emission of the organic EL element 8 by on-off control on the transistor Tr2 in place of control of power to the driving transistor Tr3.

Specifically, the pixel circuit 85R (85G and 85B) sets the transistor Tr2 in an off state by the driving signal DS1 at time point t0 at which an emission period ends. Thereby, the pixel circuit 85R (85G and 85B) stops supplying current to the organic EL element 8, and the organic EL element 8 stops emitting light.

In addition, in the pixel circuit 85R (85G and 85B), a transistor Tr4 performing on-off operation according to a driving signal DS2 is provided between the gate and the drain of the driving transistor Tr3. The pixel circuit 85R (85G and 85B) also has a writing transistor Tr1 connected to the gate of the driving transistor Tr3 via a second storage capacitor Cc. In addition, a first storage capacitor Cs is provided between the terminal on the writing transistor Tr1 side of the second storage capacitor Cc and a power supply VDD1. In the pixel circuit 85R (85G and 85B), the terminal voltage of the first storage capacitor Cs is set to a gradation setting voltage Vsig via a signal line sig. As a result, the pixel circuit 85R (85G and 85B) current-drives the organic EL element 8 by the gate-to-source voltage Vgs of the driving transistor Tr3 which voltage corresponds to the voltage across the first storage capacitor Cs. Incidentally, a fixed voltage Vofs for threshold voltage correction or the like is thereby set to a voltage corresponding to the configuration of the pixel circuit 85R (85G and 85B) (FIGS. 20A to 20I). The gradation setting voltage Vsig and the like are set with the source voltage VDD1 of the driving transistor Tr3 as a reference.

In the pixel circuit 85R (85G and 85B), the driving signal DS1 is raised at a predetermined time point t1 after the emission period ends, and thereafter the potential of the signal line sig is set to the fixed voltage Vofs by the control of a switch circuit 10.

At next time point t2, the pixel circuit 85R (85G and 85B) sets the transistor Tr4 in an on state by the driving signal DS2 to make a short circuit between the gate and the drain of the driving transistor Tr3. Thereby, in the pixel circuit 85R (85G and 85B), a charge accumulated in the organic EL element 8 is gradually discharged, and the anode voltage of the organic EL element 8 is gradually lowered. The gate voltage Vg of the driving transistor Tr3 is also gradually lowered so as to follow the lowering of the anode voltage. The cathode voltage of the organic EL element 8 stops falling when a voltage across the organic EL element 8 becomes the threshold voltage Vtholed of the organic EL element 8. The pixel circuit 85R (85G and 85B) thereby sets the gate voltage Vg of the driving transistor Tr3 to a sufficiently low voltage.

The pixel circuit 85R (85G and 85B) also sets the writing transistor Tr1 to an on state by a writing signal WS at the time point t2. The pixel circuit 85R (85G and 85B) thereby sets the voltage on the second storage capacitor Cc side of the first storage capacitor Cs to the fixed voltage Vofs. The pixel circuit 85R (85G and 85B) thereby sets the voltage across the first storage capacitor Cs to a voltage sufficiently larger than the threshold voltage Vth of the driving transistor Tr3.

The pixel circuit 85R (85G and 85B) next sets the transistor Tr2 in an off state by the driving signal DS1. Thereby, the driving transistor Tr3 is retained in a diode connection, and the drain voltage gradually rises. The gate voltage Vg also rises so as to follow the rise in the drain voltage. In the pixel circuit 85R (85G and 85B), when the gate-to-source voltage of the driving transistor Tr3 becomes the threshold voltage Vth of the driving transistor Tr3 as a result of the rise in the gate voltage Vg, current stops flowing in via the driving transistor Tr3, and the gate voltage Vg stops rising.

Thereby, in the pixel circuit 85R (85G and 85B), a voltage across the second storage capacitor Cc is set to the threshold voltage Vth of the driving transistor Tr3 on condition that the fixed voltage Vofs is set equal to the source voltage VDD1 of the driving transistor Tr3.

Thereafter, the pixel circuit 85R (85G and 85B) changes the transistor Tr4 to an off state by the driving signal DS2, and then sets the switch circuit 10 in an off state. In addition, the writing transistor Tr1 is changed to an off state.

Thereafter, in the pixel circuit 85R (85G and 85B), a switch circuit 24 is controlled to be on at time point t4. The pixel circuit 85R (85G and 85B) thereby sets the potential of the signal line sig to a precharge voltage Vpcg. The pixel circuit 85R (85G and 85B) next sets the switch circuit 24 in an off state.

The pixel circuit 85R (85G and 85B) sets the writing transistor Tr1 in an on state at next time point t5. In addition, a switch circuit 9 is simultaneously set in an on state. The pixel circuit 85R (85G and 85B) thereby sets the voltage of the terminal on the writing transistor Tr1 side of the second storage capacitor Cc to the gradation setting voltage Vsig. In addition, the gate voltage Vg of the driving transistor Tr3 is set to a voltage obtained by biasing the gradation setting voltage Vsig by the threshold voltage Vth of the driving transistor Tr3 which threshold voltage Vth is set in the second storage capacitor Cc. The pixel circuit 85R (85G and 85B) thereby sets the gradation setting voltage Vsig corrected by the threshold voltage Vth of the driving transistor Tr3 in the first storage capacitor Cs and the second storage capacitor Cc.

The pixel circuit 85R (85G and 85B) thereafter sets the switch circuit 9 in an off state, and then sets the writing transistor Tr1 in an off state. The transistor Tr2 is set in an on state by the driving signal DS1 to start an emission period. In this case, the driving transistor Tr3 drives the organic EL element 8 by a driving current according to the gate-to-source voltage Vgs determined by the first storage capacitor Cs and the second storage capacitor Cc. The gate-to-source voltage Vgs is set to a voltage obtained by adding the gradation setting voltage Vsig to the threshold voltage Vth of the driving transistor Tr3. The pixel circuit 85R (85G and 85B) thereby sets the gate-to-source voltage Vgs of the driving transistor Tr3 so as to correct variation in the threshold voltage of the driving transistor Tr3. Therefore degradation in image quality due to variation in the threshold voltage of the driving transistor Tr3 can be prevented.

Incidentally, as shown in FIGS. 21A to 21I by contrast with FIGS. 20A to 20I, variation in mobility of the driving transistor Tr3 may be corrected when the gradation setting voltage Vsig is set. Incidentally, variation in the mobility is corrected by setting the transistor Tr4 in an on state and thus charging the gate side terminal of the driving transistor Tr3 by the current of the driving transistor Tr3 for a fixed period Tμ.

Similar effects to those of each of the foregoing embodiments can be obtained also when the organic EL element 8 is driven by a P-channel type transistor as in the present embodiment.

Eighth Embodiment

It is to be noted that while in the foregoing embodiments, description has been made of a case where only the signal line is set to a precharge voltage in advance, the present invention is not limited to this. The terminal voltage of the storage capacitor may also be set to the precharge voltage in advance. Specifically, as shown by broken lines in FIGS. 20A, 20G, and 20H and FIGS. 21A, 21G, and 21H, for example, the terminal voltage of the storage capacitor Cs can be set to the precharge voltage Vpcg by temporarily raising the writing signal WS when the potential of the signal line sig is set to the precharge voltage Vpcg in the configuration of the seventh embodiment.

In addition, while in the foregoing embodiments, description has been made of a case where a process of setting the voltage across the storage capacitor to the threshold voltage of the driving transistor is performed once, the present invention is not limited to this. The process may be divided and performed a plurality of times by applying the method disclosed in Japanese Patent Laid-Open No. 2007-133284.

In addition, while in the foregoing embodiments, description has been made of a case where the potential of signal lines driven on a time division basis for three consecutive pixel circuits continuous in a horizontal direction is set to a precharge voltage simultaneously or sequentially, the present invention is not limited to this. The present invention is widely applicable to cases where signal lines are driven on a time division basis for a plurality of pixel circuits continuous in a horizontal direction.

In addition, while in the foregoing embodiments, description has been made of a case where the present invention is applied to an image display device of organic EL elements, the present invention is not limited to this. The present invention is widely applicable to image display devices formed by various self-luminous elements of a current-driven type.

The present invention is applicable to active matrix type image display devices formed by organic EL elements, for example.

The present application contains subject matter related to that disclosed in Japanese Priority Patent Application JP 2008-101452 filed in the Japan Patent Office on Apr. 9, 2008, the entire content of which is hereby incorporated by reference.

It should be understood by those skilled in the art that various modifications, combinations, sub-combinations and alternations may occur depending on design requirements and other factors insofar as they are within the scope of the appended claims or the equivalent thereof.

What is claimed is:

1. An image display device for displaying input image data on a display section formed by arranging pixel circuits in a form of a matrix by driving said pixel circuits by a signal line driving circuit and a scanning line driving circuit via a signal line and a scanning line of said display section, wherein:

said pixel circuits each include at least a light emitting element, a driving transistor configured to current-drive said light emitting element by a driving current corresponding to a gate-to-source voltage, a storage capacitor configured to retain said gate-to-source voltage, and a writing transistor configured to set a voltage across said storage capacitor by a voltage of said signal line;

said signal line driving circuit includes a data driver configured to time-division-multiplex and output gradation setting voltages for each unit of a plurality of signal lines after assigning said input image data to said signal lines and generating, for each of said signal lines, said gradation setting voltages sequentially indicating gradations of said pixel circuits connected to the respective signal lines, a switch circuit for the gradation setting voltages, said switch circuit for the gradation setting voltages distributing an output signal of said data driver to said plurality of signal lines, and a switch circuit for precharge, said switch circuit for precharge setting at least potential of the corresponding signal lines to a precharge voltage in advance of setting the gate-to-source voltage of the driving transistor when voltage of said signal lines is set to said gradation setting voltages; and said signal line driving circuit selects and outputs the precharge voltage to each of said signal lines via the switch circuit for precharge to simultaneously set each signal line in advance of sequentially setting said gradation setting voltages, and wherein the voltage across the storage capacitor is set to the threshold voltage of the driving transistor such that the potential of the plurality of signal lines is simultaneously set to the precharge voltage in advance of setting the gate-to-source voltage of the driving transistor and the gate-to-source voltage of the driving transistors of said pixel circuits are sequentially set to said gradation setting voltages of the respective signal lines.

2. The image display device according to claim 1, wherein said precharge voltage is an intermediate voltage between a maximum value and a minimum value of said gradation setting voltages.

3. The image display device according to claim 1, wherein after raising the voltage across said storage capacitor to more than a threshold voltage of said driving transistor by setting a voltage of one terminal of said storage capacitor to a fixed voltage for threshold voltage correction via said writing transistor, each of said pixel circuits sets said voltage across said storage capacitor to a voltage dependent on the threshold voltage of said driving transistor by discharging the voltage across said storage capacitor via said driving transistor; and then sets the voltage across said storage capacitor by said gradation setting voltage via said writing transistor, and said signal line driving circuit includes a switch circuit for the fixed voltage, said switch circuit for the fixed voltage simultaneously setting the voltage of said plurality of signal lines to said fixed voltage for threshold voltage correction when the voltage of said signal lines is set to said precharge voltage.

4. The image display device according to claim 1, wherein after raising the voltage across said storage capacitor to more than a threshold voltage of said driving transistor by setting a voltage of one terminal of said storage capacitor to a fixed voltage for threshold voltage correction via said writing transistor, each of said pixel circuits sets said voltage across said storage capacitor to a voltage dependent on the threshold voltage of said driving transistor by discharging the voltage across said storage capacitor via said driving transistor; and then sets the voltage across said storage capacitor by said gradation setting voltage via said writing transistor, and by time-division-multiplexing said precharge voltage and said fixed voltage for threshold voltage correction and inputting a result of time-division-multiplexing said precharge voltage and said fixed voltage for threshold voltage correction to said switch circuit for precharge, said signal line driving circuit simultaneously sets the voltage of said plurality of signal lines to said fixed voltage for threshold voltage correction in advance when the voltage of said signal lines is set to said precharge voltage.

5. A driving method of an image display device for displaying input image data on a display section formed by arranging pixel circuits in a form of a matrix by driving said pixel circuits by a signal line driving circuit and a scanning line driving circuit via a signal line and a scanning line of said display section, said pixel circuits each including at least a light emitting element, a driving transistor configured to current-drive said light emitting element by a driving current corresponding to a gate-to-source voltage, a storage capacitor configured to retain said gate-to-source voltage, and a writing transistor configured to set a voltage across said storage capacitor by a voltage of said signal line, said driving method of the image display device comprising:

a data driver processing step of outputting an output signal obtained by time-division-multiplexing gradation setting voltages for each unit of a plurality of signal lines from a data driver after assigning said input image data to said signal lines and generating, for each of said signal lines, said gradation setting voltages sequentially indicating gradations of said pixel circuits connected to the respective signal lines;

a gradation setting voltage distributing step of distributing and outputting the output signal of said data driver to said plurality of signal lines;

a precharge step of setting at least potential of the corresponding signal lines to a precharge voltage in advance of setting the gate-to-source voltage of the driving transistor when voltage of said signal lines is set to said gradation setting voltages by said gradation setting voltage distributing step; and said signal line driving circuit is configured selects and outputs the precharge voltage to each of said signal lines via the switch circuit for precharge to simultaneously set each signal line in advance of sequentially setting said gradation setting voltages, and wherein the voltage across the storage capacitor is set to the threshold voltage of the driving transistor such that the potential of the plurality of signal lines is simultaneously set to the precharge voltage in advance of setting the gate-to-source voltage of the driving transistor and the gate-to-source voltage of the driving transistors of said pixel circuits are sequentially set to said gradation setting voltages of the respective signal lines.

6. The image display device according to claim 2, wherein said intermediate voltage is a function of:

(the maximum value+the minimum value of said gradation setting voltages)/2.

7. The driving method according to claim 5, wherein said precharge voltage is an intermediate voltage between a maximum value and a minimum value of said gradation setting voltages, and wherein said intermediate voltage is a function of:

(the maximum value+the minimum value of said gradation setting voltages)/2.

* * * * *